US009694468B2

(12) United States Patent
Thomas

(10) Patent No.: US 9,694,468 B2
(45) Date of Patent: Jul. 4, 2017

(54) ROTATING SWIVEL BRUSH FOR EXTERNAL CLEANING OF TUBULARS

(71) Applicant: Thomas Engineering Solutions & Consulting, LLC, New Iberia, LA (US)

(72) Inventor: William C. Thomas, Lafayette, LA (US)

(73) Assignee: Thomas Engineering Solutions & Consulting, LLC, New Iberia, LA (US)

( * ) Notice: Subject to any disclaimer, the term of this patent is extended or adjusted under 35 U.S.C. 154(b) by 499 days.

(21) Appl. No.: 14/480,431

(22) Filed: Sep. 8, 2014

(65) Prior Publication Data

US 2014/0374087 A1 Dec. 25, 2014

Related U.S. Application Data

(63) Continuation of application No. 14/040,650, filed on Sep. 28, 2013.

(Continued)

(51) Int. Cl.
*B24B 27/00* (2006.01)
*B24B 27/033* (2006.01)

(Continued)

(52) U.S. Cl.
CPC ..... *B24B 27/033* (2013.01); *B08B 9/023* (2013.01); *B24B 5/04* (2013.01); *B24B 5/36* (2013.01);

(Continued)

(58) Field of Classification Search
CPC ..... B24B 27/033; B24B 27/0076; B24B 27/0015; B24B 5/04; B24B 5/36; B24B 51/00; E21B 37/02

(Continued)

(56) References Cited

U.S. PATENT DOCUMENTS 2,398,308 A * 4/1946 Hite ..... B24B 27/0015 451/236
3,139,774 A * 7/1964 Sipinen ..... B23D 63/14 76/40

(Continued)

FOREIGN PATENT DOCUMENTS

CN 200480012199.4 2/2009
DE 102005022727 A1 * 11/2006 ..... B24B 27/0076

(Continued)

OTHER PUBLICATIONS

Technical Industries, Inc., "Vision Array" marketing brochure, publication date unknown.

(Continued)

*Primary Examiner* — George Nguyen
(74) *Attorney, Agent, or Firm* — Zeman-Mullen & Ford, LLP

(57) ABSTRACT

Methods are disclosed for performing operations such as cleaning, inspection or data acquisition on an external surface of a hollow cylindrical tubular. Preferred embodiments include providing a fluid dispenser and an abrasion assembly on a buggy that travels up and down the length of the tubular as the tubular rotates. The fluid dispenser includes nozzles that dispense cleaning fluids onto the tubular's external surface. The abrasion assembly includes a swivel brush and a brush train providing different styles of abrasion cleaning of the tubular's external surface. Preferred embodiments of the buggy also carry a range finding laser generating samples of the distance from the laser to a sampled point on the tubular's external surface. The laser samples are processed in real time into surface contour data. Cleaning and inspection variables such as tubular rotational speed, or buggy speed, may be adjusted responsive to measured surface contour data.

20 Claims, 16 Drawing Sheets

Related U.S. Application Data

(60) Provisional application No. 61/799,425, filed on Mar. 15, 2013.

(51) Int. Cl.

| | |
|---|---|
| ***B24B 51/00*** | (2006.01) |
| ***B24B 5/04*** | (2006.01) |
| ***B08B 9/023*** | (2006.01) |
| ***E21B 37/02*** | (2006.01) |
| ***B24B 5/36*** | (2006.01) |

(52) U.S. Cl.
CPC ..... *B24B 27/0015* (2013.01); *B24B 27/0076* (2013.01); *B24B 51/00* (2013.01); *E21B 37/02* (2013.01)

(58) Field of Classification Search
USPC ..... 451/56
See application file for complete search history.

(56) References Cited

U.S. PATENT DOCUMENTS

| | | | | |
|---|---|---|---|---|
| 3,822,429 | A | 7/1974 | Thompson | |
| 4,041,773 | A | 8/1977 | Hauldren et al. | |
| 4,166,301 | A | 9/1979 | Smith | |
| 4,205,407 | A | 6/1980 | King et al. | |
| 5,060,423 | A | 10/1991 | Klotz | |
| 5,325,636 | A * | 7/1994 | Attanasio | B24B 35/00 451/164 |
| 5,460,565 | A * | 10/1995 | Perneczky | B21B 28/04 451/162 |
| 5,475,890 | A | 12/1995 | Chen | |
| 5,599,423 | A * | 2/1997 | Parker | B24B 37/042 156/345.13 |
| 5,615,696 | A | 4/1997 | Lawler | |
| 5,947,134 | A * | 9/1999 | Kim | B08B 1/007 134/153 |
| 5,963,030 | A | 10/1999 | Stark | |
| 6,158,074 | A | 12/2000 | Castille | |
| 6,425,276 | B1 | 7/2002 | Hirano et al. | |
| 7,263,887 | B2 | 9/2007 | Sfeir et al. | |
| 7,401,518 | B2 | 7/2008 | Sfeir et al. | |
| 7,552,640 | B2 | 6/2009 | Sfeir et al. | |
| 7,765,632 | B2 | 8/2010 | Lawler et al. | |
| 7,935,217 | B2 | 5/2011 | Yashiki et al. | |
| 7,997,138 | B2 | 8/2011 | Sfeir et al. | |
| 8,165,848 | B2 | 4/2012 | Knight et al. | |
| 8,360,668 | B1 | 1/2013 | Hinnant | |
| 9,156,121 | B2 * | 10/2015 | Thomas | E21B 37/02 |
| 2004/0235391 | A1 | 11/2004 | Grivna | |
| 2005/0235442 | A1 | 10/2005 | Molter | |
| 2008/0142050 | A1 | 6/2008 | Hashish et al. | |
| 2009/0217954 | A1 | 9/2009 | Hall | |
| 2010/0180915 | A1 | 7/2010 | Patel et al. | |
| 2011/0220151 | A1 | 9/2011 | Swinford | |
| 2012/0006352 | A1 | 1/2012 | Holappa et al. | |
| 2012/0028554 | A1 | 2/2012 | Weinberger et al. | |
| 2012/0074110 | A1 | 3/2012 | Zediker et al. | |
| 2013/0298950 | A1 | 11/2013 | Hann | |
| 2014/0092234 | A1 | 4/2014 | Thomas et al. | |

FOREIGN PATENT DOCUMENTS

| | | | | |
|---|---|---|---|---|
| EP | 0131065 | A2 | 1/1985 | |
| NO | WO 8907500 | A1 * | 8/1989 | B22D 31/002 |
| WO | 2009-105898 | A1 | 9/2009 | |
| WO | 2009/105899 | A1 | 9/2009 | |

OTHER PUBLICATIONS

English version of claims from Chinese Patent No. 200480012199.4.

Decuir, Perry J., "Optimizing Hydraulic Presses Using Data Acquisition Systems", proposed IFPE Paper, actual publication date unknown but prior to Feb. 1, 2012.

DMW Industries marketing video. This reference may be seen at http://www.youtube.com/watch?v+k1T018nIVxw. The stated date of publication on YouTube is Sep. 11, 2012.

International Search Report and the Written Opinion of the International Searching Authority in PCT/US2013/062778 dated Jan. 20, 2014 (8 pages).

Aqua Energy marketing video. This reference may be seen at http://www.youtube.com/watch?v=0cplrXczdos. The stated date of publication on YouTube is Jul. 30, 2010.

DMW Industries marketing video. This reference may be seen at http://www.youtube.com/watch?v=k1T018nIVxw. The stated date of publication on YouTube is Sep. 11, 2012.

Aqua Energy marketing video. This reference may be seen at http://www.youtube.com/watch?v=0cplrXczdos. The stated date of publication on YouTube is Jul. 30, 2010.

* cited by examiner

ROTATING SWIVEL BRUSH FOR EXTERNAL CLEANING OF TUBULARS

PRIORITY CLAIM AND RELATED APPLICATIONS

This application is a continuation of co-pending, commonly assigned U.S. patent application Ser. No. 14/040,650, filed Sep. 28, 2013, which in turn claims priority to now-expired, commonly assigned U.S. Provisional Patent Application 61/799,425, filed Mar. 15, 2013. This application claims priority to, and the benefit of, Ser. No. 14/040,650 and Ser. No. 61/799,425, and incorporates the entire disclosure of Ser. Nos. 14/040,650 and 61/799,425 by reference.

FIELD OF THE INVENTION

This disclosure is directed generally to technology useful in tubular cleaning operations in the oil and gas exploration field, and more specifically to cleaning and inspecting the external surfaces of tubulars such as drill pipe, workstring tubulars, and production tubulars.

BACKGROUND

Throughout this disclosure, the term "Scorpion" or "Scorpion System" refers generally to the disclosed Thomas Services Scorpion brand proprietary tubular management system as a whole.

One drawback of conventional tubular cleaning apparatus is that, with the cleaning apparatus stationary and the tubular drawn longitudinally across, the apparatus requires a large building. Range 3 drilling pipe is typically 40-47 feet long per joint, which means that in order to clean range 3 pipe, the building needs to be at least approximately 120 feet long A further drawback of the prior art is that external cleaning operations are generally completely separate operations from inspection or other data gathering operations regarding the tubular.

SUMMARY

Aspects of the Scorpion System disclosed and claimed in this disclosure address some of the above-described drawbacks of the prior art. In preferred embodiments, the Scorpion System rotates the tubular to be cleaned (hereafter, also called the "Work" in this disclosure) while keeping the Work stationary with respect to the cleaning apparatus. The Scorpion then moves the cleaning apparatus up and down the length of the Work while the Work rotates.

In currently preferred embodiments, the Work is typically rotated at speeds in a range of about 100-300 rpm, and potentially within a range of between about 0.01 rpm and about 1,750 rpm under certain criteria. However, nothing in this disclosure should be interpreted to limit the Scorpion System to any particular rotational speed of the Work. Currently preferred embodiments of the Scorpion System further draw the cleaning apparatus up and down the length of the Work at speeds within a range of about 0.001 linear inches per second and about and 10.0 linear feet per second, depending on the selected corresponding rotational speed for the Work. Again, nothing in this disclosure should be interpreted to limit the Scorpion System to any particular speed at which the cleaning apparatus may move up or down the length of the Work.

The Scorpion System provides an outer delivery system (ODS) to clean and inspect the external surface of the Work.

The ODS generally comprises a "buggy"-like device that travels back and forth above the Work while the Work rotates beneath. Embodiments of the ODS are disclosed in which the buggy travels on a track. The buggy carries structure for performing operations on the external surface of the Work as the buggy travels above the Work. Such structure includes jets for delivery of fluids such as, for example, steam, fluid-borne abrasives, high and low pressure water, compressed air and drying gas (e.g. nitrogen). Such structure further includes brushes and other abrasives for abrasive cleaning or buffing. Such structure further includes data acquisition structure for inspecting and measuring the tubular, such as, for example, lasers, optical cameras, sensors and probes.

It is therefore a technical advantage of the disclosed ODS to clean the exterior of pipe and other tubulars efficiently and effectively. By passing different types of interchangeable cleaning apparatus on a track-mounted assembly over a stationary but rotating tubular, considerable improvement is available for speed and quality of external cleaning of the tubular over conventional methods and structure.

A further technical advantage of the disclosed ODS is to reduce the footprint required for industrial tubular cleaning. By moving cleaning apparatus over of a stationary but rotating tubular, reduced footprint size is available over conventional cleaning systems that move a tubular over stationary cleaning apparatus. Some embodiments of the ODS may be deployed on mobile cleaning systems.

A further technical advantage of the disclosed ODS is to enhance the scope, quality and reliability of inspection of the exterior of the tubular before, during or after cleaning operations. Data acquisition structure such as sensors, probes and lasers may be deployed on the track-mounted assembly passing over the stationary but rotating tubular. Such data acquisition structure may scan or nondestructively examine the exterior of the tubular, either while the tubular is rotating, and/or while the exterior is being cleaned, or otherwise.

A further technical advantage of the disclosed ODS is to reduce the incidence of damage to tubulars during brushing or other abrasive contact operations. Stresses occur when brushing structure passes over a rotating tubular where the tubular's local contour or diameter is greater than nominal. The disclosed ODS provides brushing structure configured to adapt to local variations in contour and diameter of the tubular, including suspending brushes on springs in user-controllable spring equilibrium above the tubular. The brushing pressure for a nominal tubular diameter may be set, per user selection, and the spring suspensions then enable the brushing structure to adapt to local variations in contour and diameter of the tubular. The disclosed ODS also provides other contour-adapting structure such as an articulated drive shaft for a train of brushes, and a swiveling brush including an oblate spheroid-shaped brush profile.

A further technical advantage of the disclosed ODS is to reduce the incidence of areas or features on the external surface of the rotating tubular that may be "missed" by brushing structure as it passes by. Local variations in contour or diameter of the tubular, or sag or bow of the tubular, may cause areas of the tubular's external surface to lose brushing contact (or lose the desired brushing pressure). The features described in the immediately preceding paragraph for brush structure to adapt to local variations in the tubular's contour or diameter are also useful for causing brushing structure to maintain contact (or pressure) with the external surface of the tubular when the external surface momentarily "moves away" from the brushing structure.

A further technical advantage of the disclosed ODS is to maintain an optimal distance between fluid jets operating on the tubular and the external surface of the tubular. Fluid jets are provided on the ODS in order deliver fluids (in liquid or gaseous state) for cleaning and other operational purposes. An electronic control system gathers real time data regarding the local contours in the tubular's external surface and maintains an optimal distance between the fluid jets and the external surface, so that the operating effectiveness of the fluid jets is maximized without causing damage to the tubular's surface.

The foregoing has outlined rather broadly some of the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

FIGS. 1 through 4 illustrate a first embodiment of an ODS assembly (or "buggy"), designated generally on FIGS. 1 through 4 as ODS assembly 201. FIGS. 5 through 13B illustrate a second embodiment of an ODS assembly, designated generally on FIGS. 5 through 13B as ODS assembly 220. Nothing in this disclosure should be interpreted to limit the ODS to the embodiments of ODS assemblies 201 and 220 or the structural features and aspects disclosed thereon.

Figure 1:
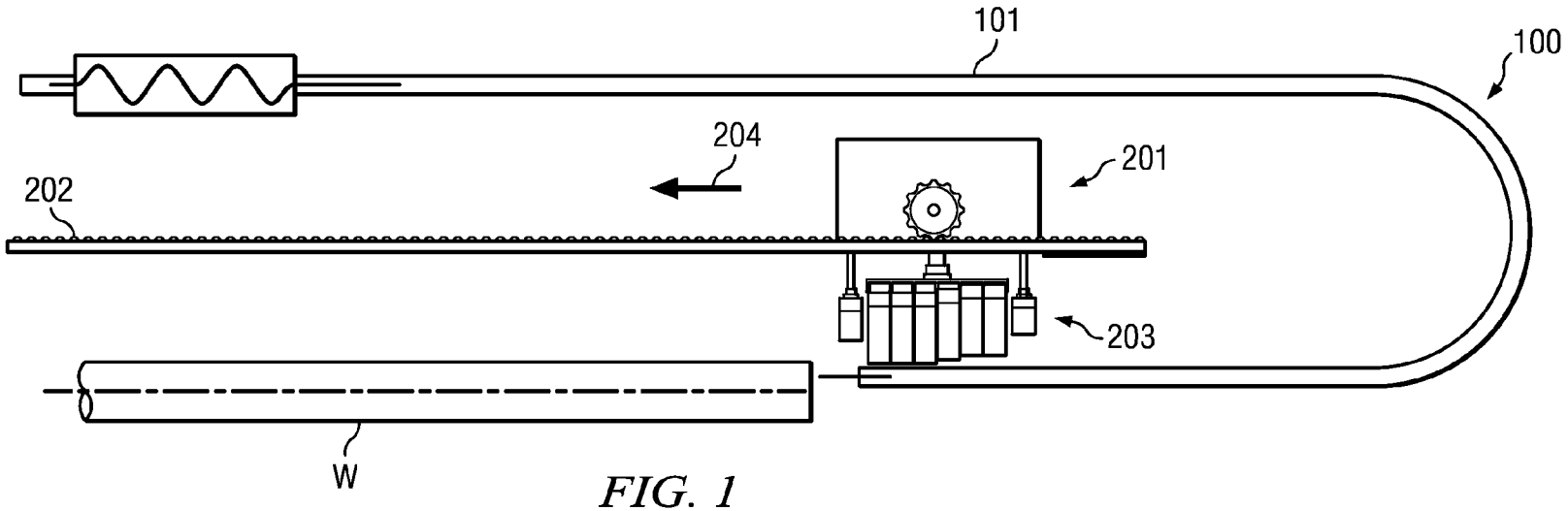
FIG. 1 is a functional-level general arrangement of one embodiment of the ODS in a combination deployment with an MLI 100.

FIG. 1 is a general arrangement drawing that illustrates, in an elevation view, an exemplary embodiment in which the ODS assembly 201 is disposed above tubular W (the Work). It will be seen and understood on FIG. 1 that ODS assembly 201 travels along track 202 while tubular W rotates. As will be described in greater detail further on, ODS assembly 201 provides a plurality of shrouded heads 203 comprising tooling that may perform a user-selected sequence of operations (including cleaning and data acquisition operations) on tubular W. As ODS assembly 201 travels along track 202 while tubular W rotates, it will be seen from FIG. 1 that ODS assembly 201 enables such user-selected sequence of operations by providing heads and associated tooling in a corresponding sequence as ODS assembly 201 comes to bear upon tubular W.

The exemplary embodiment illustrated in FIG. 1 also shows, solely for reference purposes, guide tubes 101 from a Multi-Lance Injector (MLI) assembly 100 in "curved tube" mode, as is fully disclosed in U.S. Provisional Application Ser. No. 61/707,780, priority to which Provisional Application is claimed herein (see disclosure in such Provisional Applications under the heading "Interior Cleaning of the Work"). In this way, FIG. 1 illustrates an embodiment of the Scorpion System, in which both MLI structure and ODS structure are provided together in one machine. It will be appreciated however, that nothing in this disclosure should be interpreted to require that MLI structure be combined with ODS structure in one machine. Other embodiments, not illustrated or described in this disclosure in any detail, may provide MLI structure and/or ODS structure in stand-alone machines Referring again to FIG. 1, it will be understood that certain conventional structure has been omitted for clarity. For example, ODS assembly 201, track 202 and guide tubes 101, for example, are advantageously supported by structural steel and other conventional support means (including, in some embodiments, a gantry for maintenance access), all of which has been omitted for clarity. Operation of the ODS is advantageously accomplished using conventional hydraulic, pneumatic or electrical apparatus (including geared drive motor apparatus to cause ODS assembly 201 to travel track 202 as illustrated by arrow 204 on FIG. 1), all of which has been also omitted for clarity.

Figure 2:
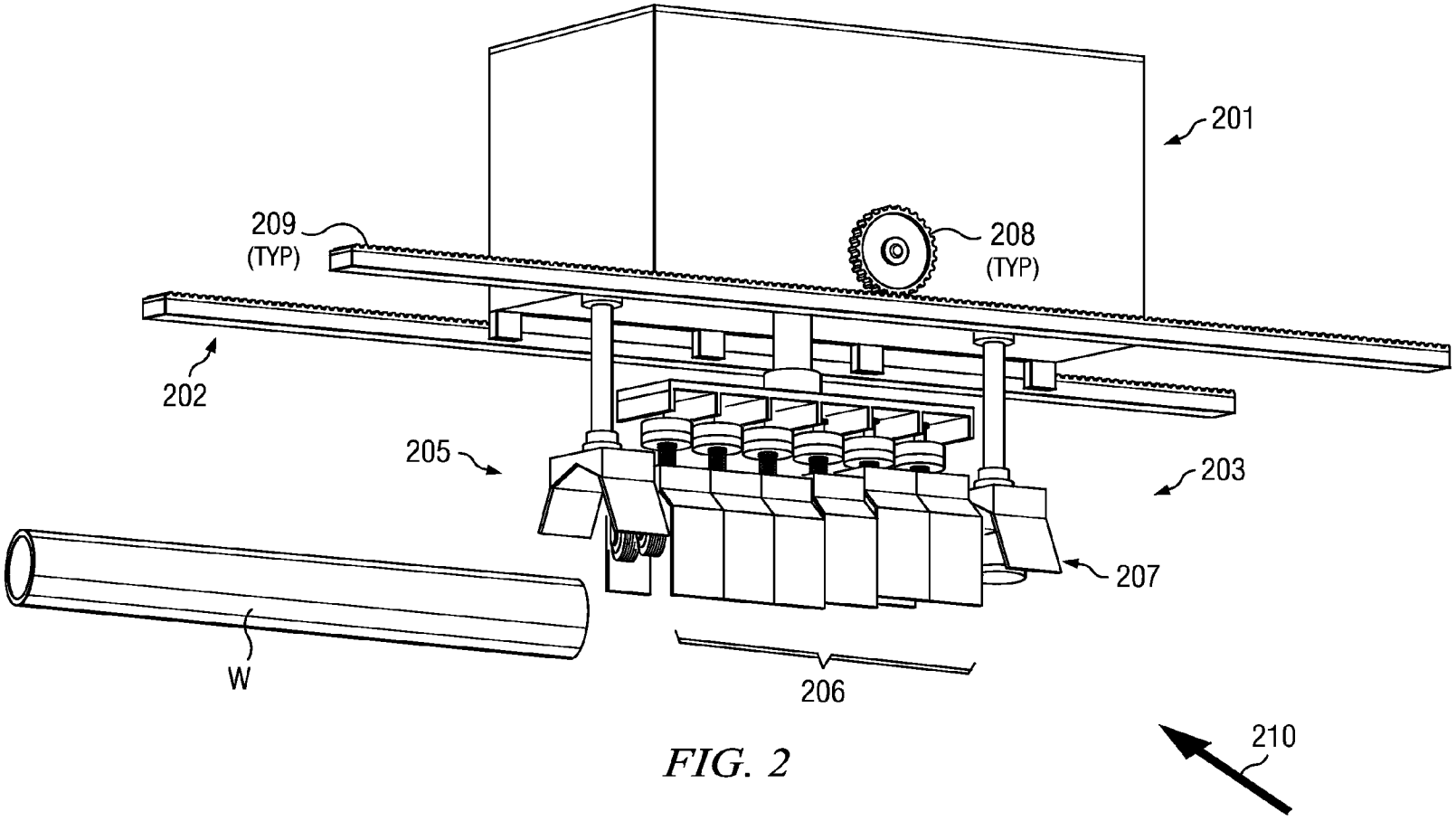
FIG. 2 is an enlargement of FIG. 1 in isometric view.

Turning now to FIG. 2, an embodiment of ODS assembly 201 is illustrated in more detail. It will be appreciated that FIG. 2 is a perspective view of the embodiment shown on FIG. 1, looking back at ODS assembly 201 from tubular W, slightly from underneath. The embodiment of FIG. 2 illustrates ODS assembly 201 operable to move up and back along track 202 via motorized gear wheels 208 on either side of ODS assembly 201 (only one side's gear wheel 208 visible on FIG. 2), whereby motorized gear wheels 208 run in geared rails 209 deployed on track 202. It will be understood, however, that the motorized gear propulsion mechanism for ODS assembly 201 illustrated on FIG. 2 is exemplary only, and any other operable propulsion mechanism for ODS assembly 201 is within the scope of this disclosure.

FIG. 2 also depicts shrouded heads 203 in more detail. Each of shrouded heads 203 comprises tooling surrounded by a shroud. A primary purpose of the shroud is to prevent by-products from the operation of the tooling (e.g. steam, water, dirt and rust removed from the outside of tubular W) from dispersing excessively into the airspace surrounding ODS assembly 201.

The tooling included in shrouded heads 203 is user-selectable according to operational needs. In the exemplary embodiment illustrated in FIG. 2, shrouded heads 203 comprise nozzle head 205, then six abrasive heads 206, and then probe head 207. Nothing in this disclosure should be interpreted, however, to limit the ODS to any particular type or amount of tooling, or the number of shrouded heads on which it is embodied, or the sequence in which it is brought to bear on tubular W.

Figure 3:
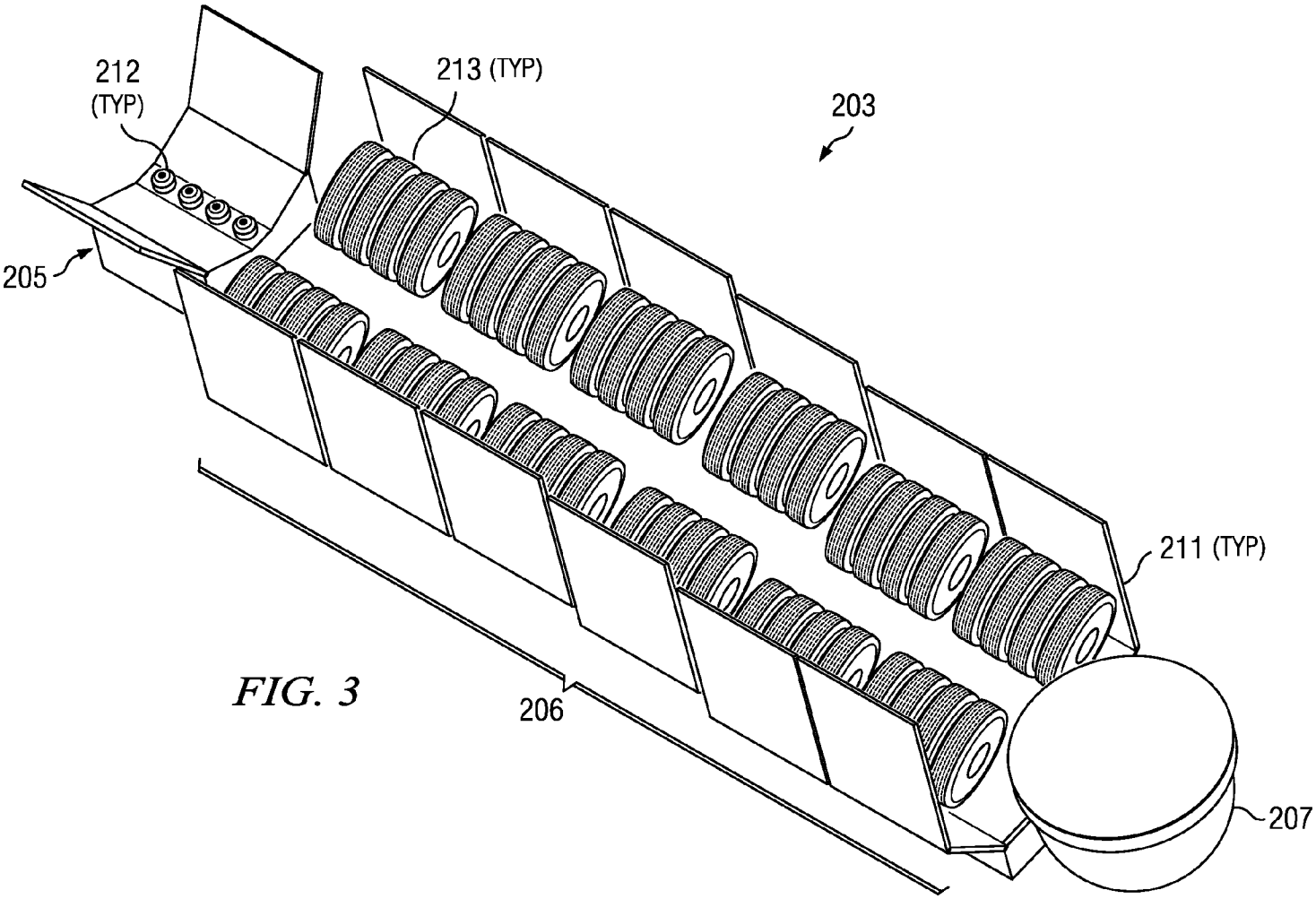
FIG. 3 depicts the underside of one embodiment of the ODS from the view of arrow 210 on FIG. 2.

Reference is now made to FIG. 3, which illustrates the tooling in the exemplary embodiment of FIG. 2 in more detail. FIG. 3 depicts shrouded heads 203 as also shown on FIGS. 1 and 2 from underneath, in the direction of arrow 210 as shown on FIG. 2. Nozzle head 205, abrasive heads 206 and probe head 207 may be seen on FIG. 3, as also seen on FIG. 2. FIG. 3 also depicts each shrouded head 203 comprising tooling surrounded by a shroud (the shrouds labeled reference numeral 211 on FIG. 3).

Referring back briefly to FIGS. 1 and 2 together, it will be seen that when ODS assembly 201 begins its travel in the direction of arrow 204 on FIG. 1 and comes to bear on tubular W, the currently preferred embodiment of the ODS provides nozzle head 205 as the first of shrouded heads 203 to operate on tubular W. Abrasive heads 206 follow nozzle head 205, and probe head 207 follows abrasive heads 206. This exemplary user-selected sequence of shroud heads 203 reflects the following sequence of tubular cleaning and data acquisition operations (although nothing herein should be construed to limit the ODS to the following operational sequence):

Nozzle Head 205—First Nozzle Group:

High pressure water blast (nominally at about 20,000 psi but not limited to any such pressure) for concrete removal and general hydroblasting operations, especially if tubular W has a severely rusted or scaled outer surface.

Nozzle Head 205—Second Nozzle Group:

Low pressure/high temperature wash, nominally at 3,000 psi/300 deg F but not limited to any such pressure or temperature), for general tubular cleaning operations, including salt wash and rust inhibitor coating.

Abrasive Heads 206:

Abrasive surface cleaning and treatment of outer surface of tubular W via steel wire brush and/or flap wheels for removal, for example, of protruding steel burrs on the outer surface of tubular W.

Probe Head 207:

Data acquisition devices and/or sensors examining outer surface of tubular W.

Looking now at FIG. 3 in greater detail, it will be seen that nozzle head 205 comprises one or more nozzles 212. FIG. 3 depicts four (4) nozzles 212, in a line off center. However, such configuration of nozzles 212 on FIG. 3 is exemplary only, and nothing in this disclosure should be construed to limit nozzle head 205 to provide any particular number of nozzles 212 in any particular configuration. Other embodiments, consistent with the scope of this disclosure, might provide fewer or greater than four (4) nozzles 212, and might deploy them on center or in different locations off center.

Relating nozzle head 205 as shown on FIG. 3 to the exemplary ODS operational sequence described above, it will be seen that nozzles 212 on nozzle head 205 may enable both the high pressure wash and the low pressure wash. It will be further appreciated that different embodiments of nozzle head 205, wherein each nozzle head 205 provides different numbers, locations and configurations of nozzles 212, may enable different combination of operations (such as steam clean, wash, rinse, spray, coat, etc.) according to user selection.

Relating abrasive heads 206 as shown on FIG. 3 to the exemplary ODS sequence described above, it will be appreciated that abrasive heads 206 may provide steel brushes, rattling heads, flap wheels or any other abrasive tooling in any combination or sequence to further clean, treat or smooth the outer surface of tubular W. FIG. 3 depicts abrasives 213 on abrasive heads 206 in generic form for this reason. In a currently preferred embodiment of the ODS, for example only, the three (3) abrasive heads 206 nearest nozzle head 205 provide abrasives 213 in the form of rotating steel brushes, while the three (3) abrasive heads 206 nearest probe head 207 provide abrasives 213 in the form of rotating flap wheels. In this embodiment, optionally, a nozzle 212 on neighboring nozzle head 205, or on any of abrasive heads 206 themselves, may also be provided and dedicated to cleaning the steel brushes embodying abrasives 213. Nothing in this disclosure should be construed, however, to limit the ODS to this embodiment, or to any configuration, type or number of abrasives 213 or abrasive heads 206.

Probe head 207 as shown on FIG. 3 provides data acquisition probes and sensors for examining and acquiring information about tubular W's outer surface, condition, wall thickness and other parameters. This examination and information gathering process is disclosed in greater detail below in paragraphs near the end of this disclosure describing the Data Acquisition System ("DAS"). Probe head 207 may provide all types of sensors, including, without limitation, magnetic, ultrasonic, laser and other types of sensors. Nothing in this disclosure should be interpreted to limit the type or number of sensors provided by probe head 207.

Although not illustrated, other embodiments of the ODS may supplement the data acquisition capability of probe head 207 by optionally providing additional sensors on the inside of shrouds 211. For reference, shrouds 211 are called out on FIG. 3.

Sensor data from probe head 207 and shrouds 211 may be further enhanced or supplemented by the optional addition of imaging technology positioned to scan tubular W's outer surface during ODS operations (such optional imaging technology not illustrated). For example, a thermal imaging camera ("infrared thermography") may be used to detect, record and quantify temperature differentials in the outer surface of tubular W. Such temperature differentials may typically (1) indicate excess moisture found in cracks and pores in tubular W, and (2) measure rates of heat exchange in steel densities and volumes. The imaging data may thus be used easily and conventionally to detect cracks, thickness variations, and porosity in the wall or on the surface of tubular W.

Advantageously, the imaging data may be in the form of a Gaussian (i.e. rainbow) color swath, conventionally displaying lower temperatures in "cooler" colors such as blue, green and cyan, and higher temperatures in "hotter"/"brighter" colors such as red, yellow and magenta. Anomalies in tubular W such as a surface crack, subsurface crack, porous pipe wall (i.e. less dense wall), and/or variation in wall thickness may be identified via detection of a corresponding temperature gradient (caused by excess moisture and thus lower temperatures in and around the anomaly) when compared to the temperature gradient of a healthy/continuous run of steel. While such temperature gradient analysis is available at ambient temperatures, the sensitivity (and corresponding efficacy) of the analysis is enhanced if hot water is applied prior to scanning.

Referring back now to FIG. 1, it will be appreciated that although not illustrated in FIG. 1, the Scorpion System's ODS is operable via conventional positioning apparatus to position tubular W with respect to ODS assembly 201 ready for operations. In a preferred embodiment, such positioning apparatus may move ODS assembly 201 with respect to tubular W so as to correctly position the operational tooling on ODS assembly 201 with respect to the external surface of tubular W. In other embodiments, such positioning apparatus may alternatively, or also, position the tubular W with respect to ODS assembly 201.

Figure 4:
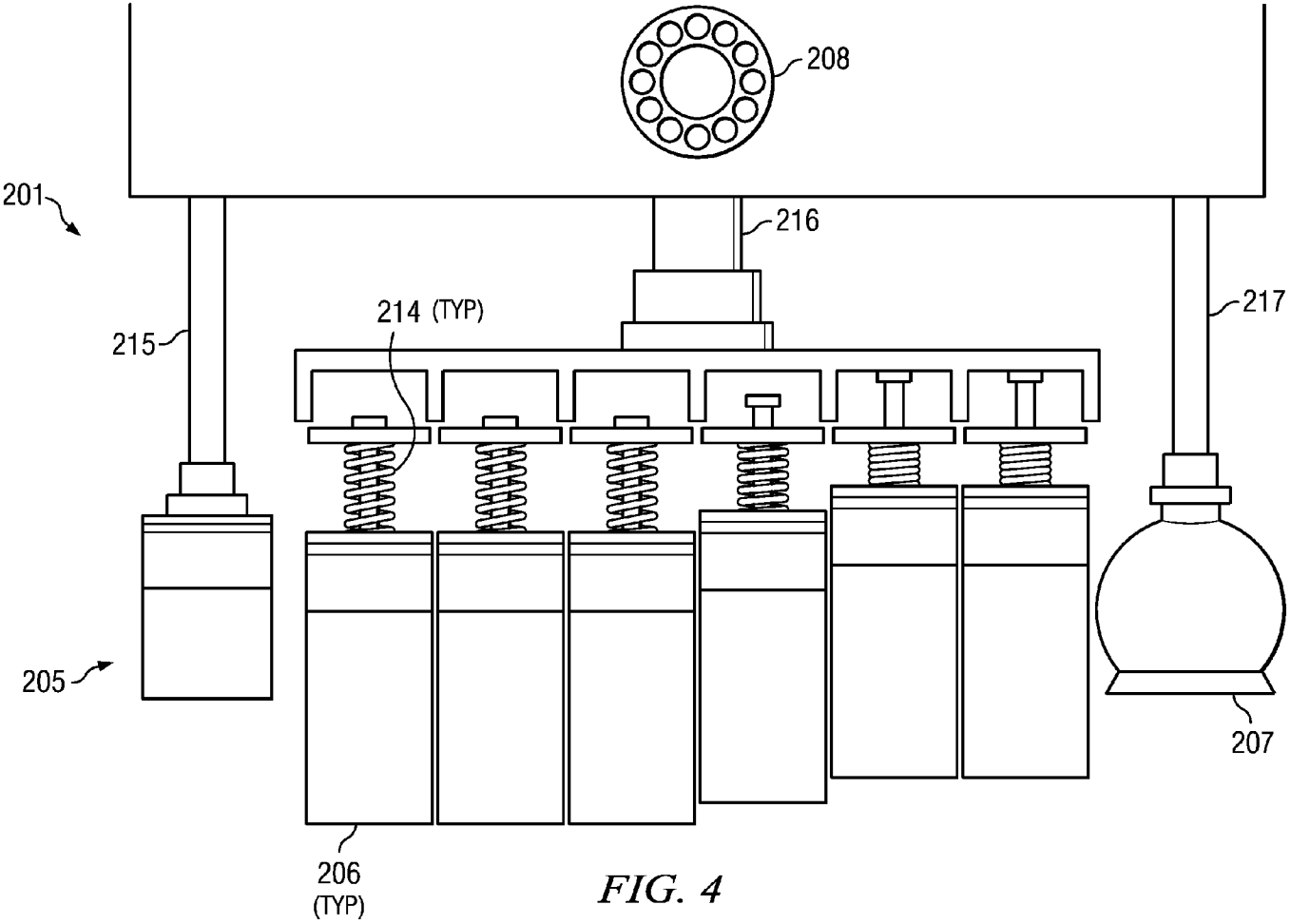
FIG. 4 illustrates one embodiment of the ODS in elevation view.

FIG. 4 illustrates additional, more precise positioning apparatus once ODS assembly 201 is initially positioned with respect to tubular W by conventional positioning apparatus, per the previous paragraph. FIG. 4 is an enlargement of ODS assembly 201 shown more generally on FIG. 1, and depicts aspects of ODS assembly 201 in greater detail. FIG. 4 further depicts ODS assembly 201, nozzle head 205, abrasive heads 206, probe head 207 and gear wheel 208 consistent with the correspondingly-numbered features shown on FIGS. 1 and 2 (and such features' accompanying disclosure herein).

Referring now to FIG. 4, it will be seen that nozzle head 205 is suspended on nozzle head piston 215, while probe head 207 is suspended on probe head piston 217. Abrasive heads 206 generally, as a group, are suspended on abrasive head piston 216. Abrasive heads 206 are then further suspended individually via corresponding abrasive head springs 214. In this way, each of nozzle head 205, abrasive heads 206 and probe head 207 may be more precisely positioned, independently of one another, with respect to the outer surface of tubular W (tubular W omitted for clarity on FIG. 4) according to user selection.

With respect to nozzle head 205, FIG. 4 shows that independent extension and retraction of nozzle head piston 215, as required, will allow nozzle head 205 to be positioned to a precise user-selected location above the outer surface of tubular W. Likewise, FIG. 4 shows that independent extension and retraction of probe head piston 217, as required, will allow probe head 207 to be positioned to a precise user-selected location above the outer surface of tubular W.

With respect to abrasive heads 206, as a group, FIG. 4 shows that extension and retraction of abrasive head piston 216 will allow abrasive heads 206, as a group, to be positioned to a precise user-selected location above the outer surface of tubular W. Further, via compression and release of abrasive head springs 214, FIG. 4 shows that abrasives 213 on abrasive heads 206 (see FIG. 3) may be kept in spring pressure contact with the outer surface of tubular W while abrasive heads 206 operably move along tubular W. Further, the independent suspension of each abrasive head 206 on its own abrasive head spring 214 allows each abrasive head 206 (and corresponding abrasives 213) to conform to the local shape or contour of the outer surface of tubular W as it operably moves along tubular W.

Although FIG. 4 illustrates an embodiment of ODS assembly 201 in which each abrasive head 206 has one corresponding abrasive head spring 214, it will be understood that the scope of this disclosure is not limited in this regard. It will be appreciated that suspension on additional springs may allow individual abrasive heads 206 to conform yet more closely (e.g., via pivoting) to the local shape or contour of the outer surface of tubular W as it operably moves along tubular W. In other embodiments, some described with reference to FIGS. 5 through 11, neighboring individual abrasive heads 206 may be connected together via, for example, an articulated connection, to create a similar effect.

Referring again to nozzle head piston 215, abrasive head piston 216 and probe head piston 217 on FIG. 4, it will be understood that the scope of this disclosure is not limited to extending or retracting these pistons to position their corresponding heads solely prior to commencing operations. It will be appreciated that further extensions or retractions of pistons 215, 216 and/or 217 may alter, as required, the precise position of nozzle head 205, abrasive heads 206 and probe head 207 with respect to the outer surface of tubular W while ODS assembly 201 is moving with respect to tubular W. It will be further understood, however, that in some embodiments, lasers and magnetic proximity sensors (not illustrated) are a primary means of adjustment for contours in the outer surface or tubular W, rather than extensions or retractions of pistons 215, 216 and/or 217 on the fly.

Reference is now made to FIGS. 5 through 13B, which illustrates ODS assembly 220 as an alternative embodiment to ODS assembly 201 as illustrated on FIGS. 1 through 4. It will be appreciated that the disclosure above to general principles, features and aspects of the ODS, regardless of the embodiment of ODS assembly or "buggy", applies equally to the embodiments disclosed below with reference to FIGS. 5 though 13B.

Figure 5:
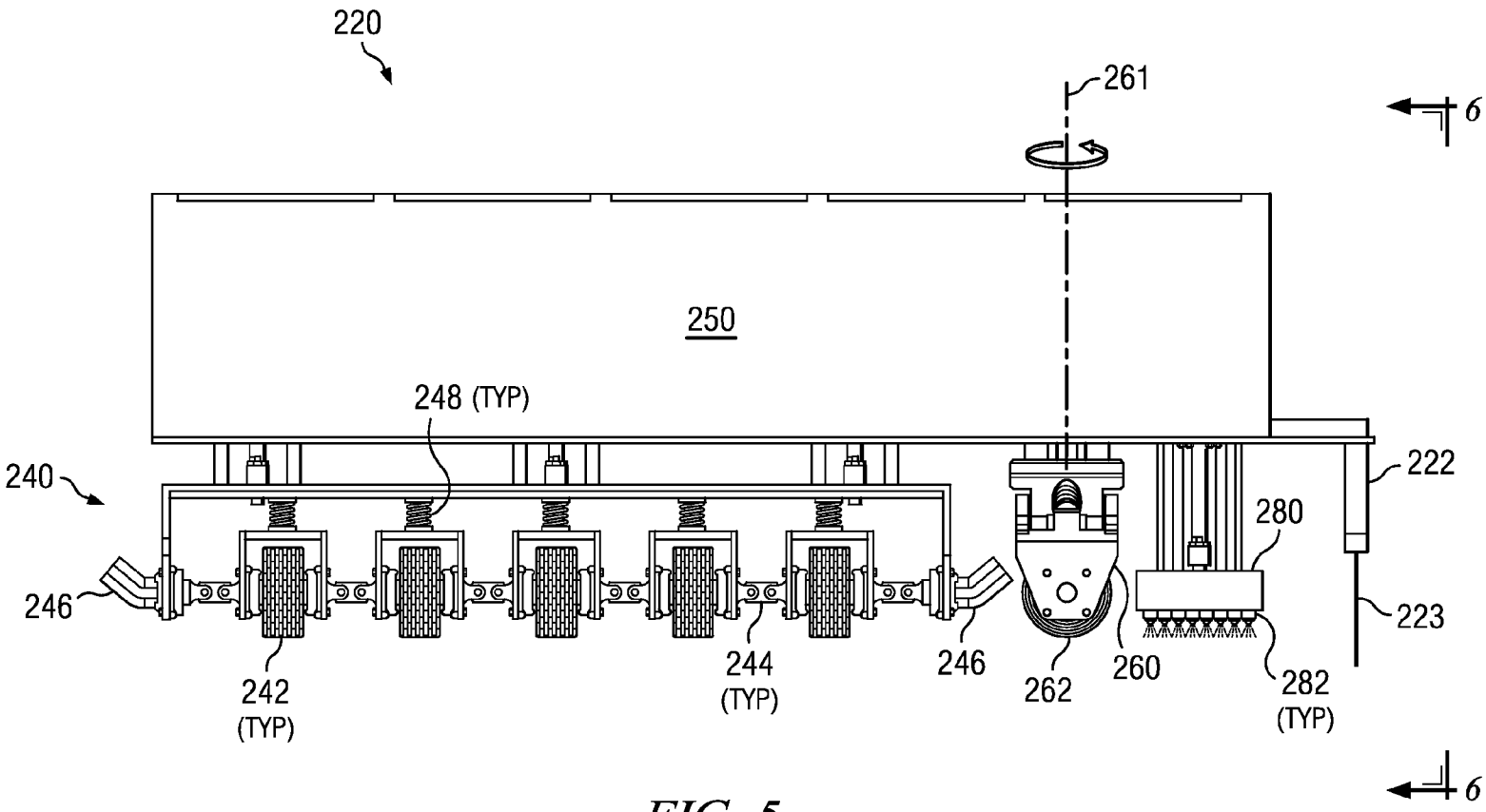
FIG. 5 illustrates another embodiment of the ODS in elevation view.

Further, for the avoidance of confusion on FIGS. 5 though 13B, it will be understood that, for illustration purposes on this disclosure only, alternative ODS assembly embodiments 201 and 220 are illustrated to run in opposite directions from a default rest position (such default resting position defined for purposes of this paragraph only as resting ready to begin engaging a tubular). ODS assembly 201 embodiment on FIGS. 1 through 4 is illustrated to run right-to-left on the page from a default rest position (see arrow 204 on FIG. 1 and associated disclosure above). In contrast, ODS assembly 220 embodiment of FIGS. 5 though 13B is illustrated to run left-to-right on the page from such a default rest position.

Thus, with reference to FIG. 5, as ODS assembly 220 moves and engages a tubular beneath, ODS laser 222 first detects the end of the tubular and then ODS laser 222's field of view 223 begins to scan the external surface of the tubular below as the tubular rotates. Information from scanning by ODS laser 222 is used by ODS assembly 220's control system (not illustrated) to inspect and analyze characteristics of the tubular as described in greater detail below. Currently-preferred embodiments of ODS assembly 220 further include an optical camera also deployed in combination with ODS laser 222. The optical camera also scans the tubular beneath within field of view 223 as illustrated on FIG. 5 (and other Figures) and receives corresponding images of the tubular for processing in combination with information from ODS laser 222. For the avoidance of doubt, the term "ODS laser 222" as used hereafter in this disclosure refers to a combination of a laser and an optical camera scanning the tubular in field of view 223. The operation of the laser and optical scanner in combination is discussed further below in this disclosure.

FIG. 5 further depicts ODS assembly 220 providing fluid jet assembly 280 next to ODS laser 222. Fluid jet assembly 280 provides jets 282, which spray or blast fluids (in gaseous or liquid state) onto the external surface of a rotating tubular beneath. Individual jets 282 are user-selectable according to operational needs. By way of example only, and without limitation, jets 282 may provide: (1) a steam blast, a high pressure water blast (nominally at about 20,000 psi but not limited to any such pressure) or even a fluid-borne abrasive blast for operations such as concrete removal or hydroblasting operations, especially if tubular W has a severely rusted or scaled outer surface; (2) a low pressure/high temperature wash (nominally at 3,000 psi/300 deg F. but not limited to any such pressure or temperature), for general tubular cleaning operations, including salt wash and rust inhibitor coating; and/or (3) a compressed air or gas (such as nitrogen) blast, for drying or (in the case of compressed air) removal of surface debris. Fluid jet assembly 280 is described in greater detail below with reference to FIGS. 13A and 13B.

FIG. 5 further depicts swivel brush assembly 260 next to fluid jet assembly 280 on ODS assembly 220. Swivel brush assembly 260 provides swivel brush 262 (which may, per further disclosure below, be a laminate of planar brushes) at the point of contact with the external surface of a rotating tubular beneath. Swivel brush assembly 260 further provides axle structure and conventional power apparatus (such as hydraulic, electric or pneumatic motors) to power-rotate the swivel brush 262 at user-selected speeds on user-selected speed cycles. Swivel brush 262 may be of any suitable size, profile or construction, per user selection, and this disclosure is not limited in this regard. In the embodiments illustrated on FIGS. 5 though 13B, swivel brush assembly 260 provides one swivel brush 262 having an oblate spheroid shape and profile, although swivel brush 262 is not limited to a single brush in other embodiments.

Swivel brush assembly 260 may further be rotated, per user control and selection, about its vertical axis 261 as shown on FIG. 5. In this way, swivel brushes (including, on FIG. 5, swivel brush 262) may be caused to abrade the external surface of a tubular at any user-selected angle relative to the axis of the tubular's rotation. Changes may be made to the angle of abrasion on the fly. This feature acknowledges that certain common oilfield tubulars, such as drill pipe, are conventionally turned in a clockwise direction as drilling into the earth progresses. This drilling rotation causes helical scratching and scarring on the external surface of the tubular. The ability to set and adjust the angle of abrasion on swivel brush assembly 260 permits a more effective cleaning of external surfaces that may have a helical scratch or scar pattern.

Swivel brush assembly 260 on FIG. 5 is also disposed to "tilt" or pivot so that swivel brush 262 follows the contour of a rotating tubular beneath. Such "tilting" or pivoting is about a substantially horizontal axis. Once the general height of swivel brush assembly 260 above a tubular is set, "tilting" or pivoting structure takes over to allow swivel brush assembly 260 to follow the contour of the tubular, while spring structure on swivel brush assembly 260 permits the swivel brush (or brushes) to maintain a substantially constant contact on the surface of the tubular as they pass over local variations in the tubular's diameter. Swivel brush assembly 260 (including the "tilting"/pivoting feature and the contouring feature) is described in greater detail below with reference to FIGS. 12A through 12E.

FIG. 5 further depicts fixed brush train 240 next to swivel brush assembly 260 on ODS assembly 220. Fixed brush train 240 comprises fixed brushes 242, each configured to rotate generally about an axis parallel to the longitudinal axis of a tubular beneath. In illustrated embodiments, fixed brushes 242 provide circular ("wheel"-like) brushes at the point of contact with the external surface of a rotating tubular beneath. Fixed brush train 240 further connects fixed brushes 242 together into a concatenated train thereof via articulated brush joints 244. Embodiments of articulated joints may include conventional u-joints or any other structure suitable for connecting neighboring fixed brushes 242 in articulated fashion. As shown on FIG. 5 (and subsequent Figures), articulated brush joints 244 form an articulated drive shaft which drives fixed brushes 242 to rotate in unison. Individual fixed brushes 242 are thus permitted to move vertically semi-independently of one another, while still all being driven in unison by the articulated drive shaft formed by articulated brush joints 244. Conventional power apparatus (such as hydraulic, electric or pneumatic motors) at either or both ends of fixed brush train 240 may power-rotate all of the fixed brushes in unison at user-selected speeds on user-selected speed cycles. Fixed brushes 242 may be of any suitable number, size, profile or construction, per user selection, and this disclosure is not limited in this regard. In the embodiments illustrated on FIGS. 5 through 11, fixed brushes 242 have a conventional cylindrical shape and profile. Alternatively one or more fixed brushes 242 may have the oblate spheroid ("football") shape described above with respect swivel brush 262 elsewhere in this disclosure, or any user-selected design. It will be also understood that this disclosure is not limited to the number of fixed brushes 242 that may deployed on fixed brush train 242. In the embodiments illustrated on FIGS. 5 though 13B, fixed brush train 240 provides five (5) fixed brushes 242 concatenated into an articulated train, separated by articulated brush joints 244 and driven by two fixed brush motors 246. Nothing in this disclosure should be interpreted, however, to limit fixed brush train 240 to any specific number of fixed brushes 242 and/or brush motors 246.

The concept of the term "fixed" on fixed brush train 240 (as opposed to the term "swivel" on swivel brush assembly 260 described above) refers to the fact that fixed brushes 242 on fixed brush train 240 do not rotate about a vertical axis normal to the axis of rotation of the tubular, and are further constrained from doing so by the interconnection provided by articulated brush joints 244. Fixed brushes 242 on fixed brush train 240 instead form a series of abrading surfaces that rotate in unison on the external surface of the rotating tubular beneath, where the angle of abrasion is consistently normal to the longitudinal axis of the tubular.

FIG. 5 further illustrates that fixed brush train 240 suspends fixed brushes 242 from shock absorbers 248. In the embodiments illustrated on FIGS. 5 to 13B, shock absorbers 248 are spring mechanisms, and fixed brush train 240 provides one shock absorber 248 for each fixed brush 242, although this disclosure is not limited in this regard. It will be appreciated from FIG. 5 that shock absorbers 248 further regulate the semi-independent vertical movement provided to each fixed brush 242 by articulated brush joints 244. The semi-independent vertical movement permits each individual fixed brush 242 the independent freedom to follow the local contour of the rotating tubular beneath as fixed brushes 242 pass over the tubular. Fixed brush motors 246 may nonetheless still drive all fixed brushes 242 in unison. Shock absorbers 248 regulate the independent vertical movement of each fixed brush 242, requiring each fixed brushes 242 to maintain a substantially constant contact on the surface of the tubular as it passes over local variations in the tubular's diameter. Once the general height of fixed brush train 240 above a tubular is set, shock absorbers 248 take over to allow each fixed brush 242 to follow the local contour of the tubular as it passes by beneath. Fixed brush train 240 is described in greater detail below with reference to FIG. 11.

It should be noted that although the above disclosure has referred, with respect to FIG. 5, to swivel brush assembly 260 and fixed brush train 240, nothing in this disclosure should be interpreted to limit swivel brush assembly 260 and fixed brush train 240 to "brushes" in the sense of an abrasion tool with bristles. Swivel brush 262 and fixed brushes 242 may be any abrasive tool, including, but not limited to, wire brushes, flap wheels, or abrasive stone or composite wheels.

FIG. 5 further illustrates top shroud 250 covering structure above fixed brush train 240, swivel brush assembly 260 and fluid jet assembly 280. Top shroud 250 protects against steam, dust, debris, fluid overspray and other by-products of cleaning operations below. Fluid jet assembly 280 is also advantageously covered by a shroud (omitted on FIGS. 5 through 13B for clarity) during operations in order to contain steam, fluid overspray, debris, etc., caused by the operation of jets 282. A further containment structure advantageously deployed about the entire operation of ODS assembly 220 (again, omitted on FIGS. 5 though 13B for clarity) restrains steam, fluid overspray, dust, debris, etc. from contaminating the general surroundings, and further enables recycling of recyclable fluids after jets 282 may have administered them.

Figure 6:
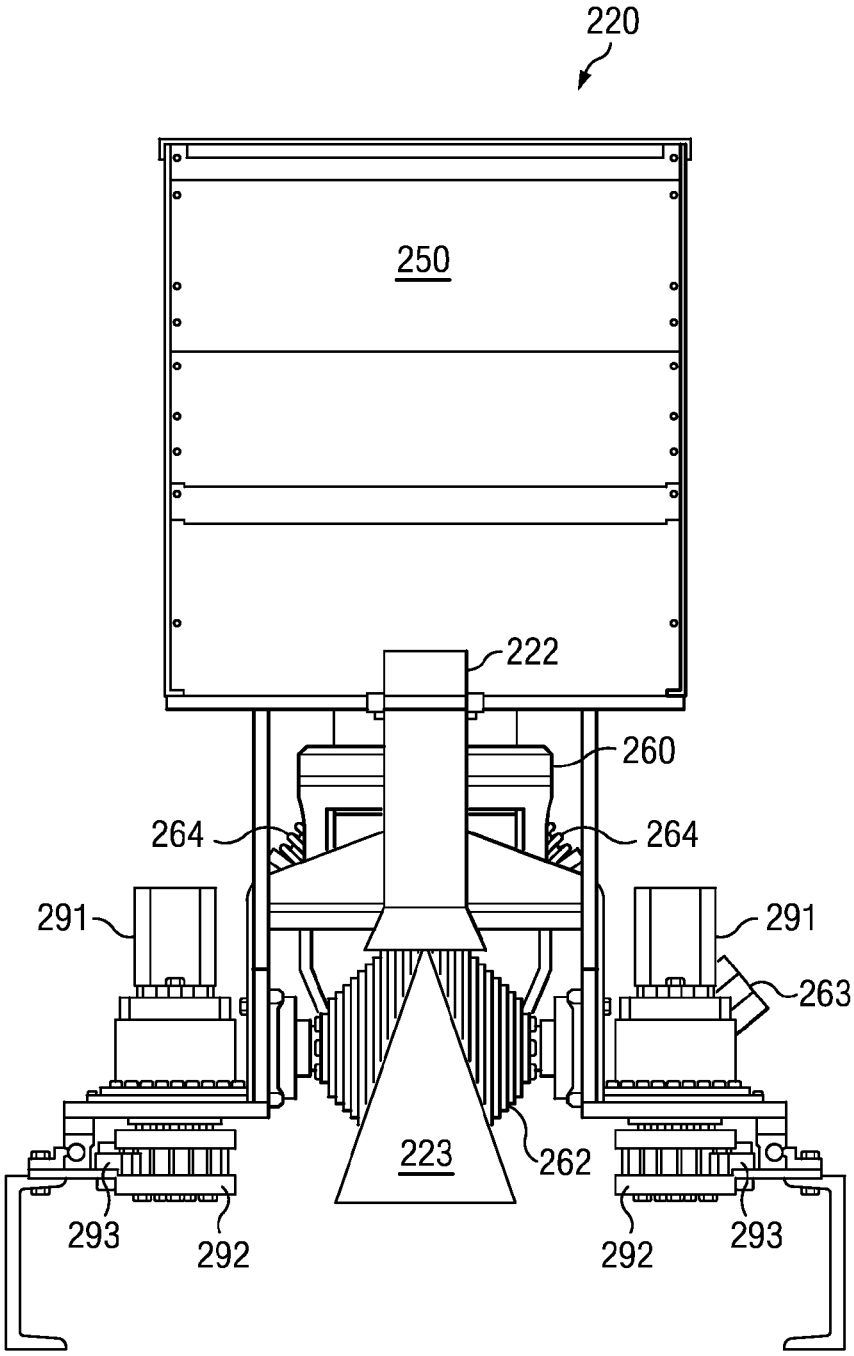
FIG. 6 is an end view as shown on FIG. 5.

FIG. 6 is an end view of ODS assembly 220 as shown on FIG. 5. FIG. 6 illustrates features and aspects of ODS assembly 220 as also shown on FIG. 5. FIG. 6 also illustrates features and aspects of ODS assembly 220 that were omitted from FIG. 5 for clarity. Fluid jet assembly 280, however, which was shown and described above with reference to FIG. 5, is omitted for clarity from FIG. 6 so that features and aspects of swivel brush assembly 260 may be better seen.

FIG. 6 depicts ODS assembly with top shroud 250, ODS laser 222 and laser field of view 223, as described above more fully with reference to FIG. 5. Swivel brush assembly 260 may also be seen on FIG. 6, including swivel brush 262, as also described above with reference to FIG. 5. It will be seen on FIG. 6 more clearly that in the ODS assembly embodiment of FIGS. 5 though 13B, swivel brush 262 has been user-selected to be in the shape and profile of an oblate spheroid (although swivel brush 262 as disclosed herein is not limited to such a shape and profile). The oblate spheroid shape may be created by laminating together a plurality of planar circular brushes of gradually varying diameter. The laminate may vary from smallest diameter at the ends up to largest diameter in the middle.

The oblate spheroid (or colloquially, "football") shape and profile gives advantageous results when the angle of abrasion is rotated towards normal to the longitudinal axis of the tubular underneath. An optimal angle of attack may be found for abrading the external surface of the tubular, where the oblate spheroid shape maximizes contact and abrasive efficiency in view of the local contour or diameter of the tubular immediately below swivel brush 262. It will be appreciated that as the angle of abrading attack approaches normal (90 degrees) to the longitudinal axis of the tubular, the more the coned edge of the oblate spheroid shape comes to bear on contours on the tubular, reducing the potential brush pressure of swivel brush 262 on contours that increase the local diameter of the tubular. Tilting structure on swivel brush assembly 260, as described in more detail below, with reference to FIGS. 12A through 12E, further mitigates against damage to the tubular from swivel brush 262 contacting the external surface of the tubular too hard (especially during tubular contour changes that increase the tubular's local diameter). Tilting springs 264 (which are part of the tilting structure described in more detail with reference to FIGS. 12A through 12E) may be seen on FIG. 6, although partially hidden from view. Likewise swivel brush motor 263 (for power rotating swivel brush 262) may also be seen on FIG. 6, although again partially hidden from view. As noted above with reference to FIG. 5, swivel brush motor 263 may be any conventional power apparatus (such as a hydraulic, electric or pneumatic motor) to power-rotate swivel brush 262 at user-selected speeds on user-selected speed cycles.

It is useful to highlight some of the advantages provided by the ability of swivel brush assembly 260 and fixed brush train 240 to adapt to local variations in contour and diameter of the tubular beneath, as described above with reference to FIGS. 5 and 6. Without such ability to adapt to local variations in contour and diameter, "forcing" a rotating tubular under swivel brushes or fixed brushes may place undesirable local stress on, for example, the tubular, the ODS assembly, the structure for rotating the tubular, and the structure for supporting the tubular while it rotates. Over time, such undesirable stress may cause failures, or at least premature wear and tear on the tubular and/or the surrounding ODS and related structure. The ability of swivel brush assembly 260 and fixed brush train 240 to adapt to local variations in contour and diameter of the tubular thus mitigates against such stresses, wear and tear, and/or failures.

A further advantage provided by the ability of swivel brush assembly 260 and fixed brush train 240 to adapt to local variations in contour and diameter of the tubular is that, in combination with the ability to power-rotate swivel brush 262 and fixed brushes 242 in either direction, substantial improvements in the operational life of brushes become available. The ability of swivel brush assembly 260 and fixed brush train 240 to adapt to local variations assists in keeping swivel brush 262 and fixed brushes 242 at (or near) optimal brush pressure on the external surface of the tubular, avoiding premature brush wear by "crushing" the brushes and wear surfaces together. Further, the ability to periodically reverse the direction of rotation of swivel brush 262 and fixed brushes 242 during brushing operations (as may be required in ODS cleaning operation cycles anyway) further serves to enhance brush life by distributing brush wear more evenly.

Figure 10:
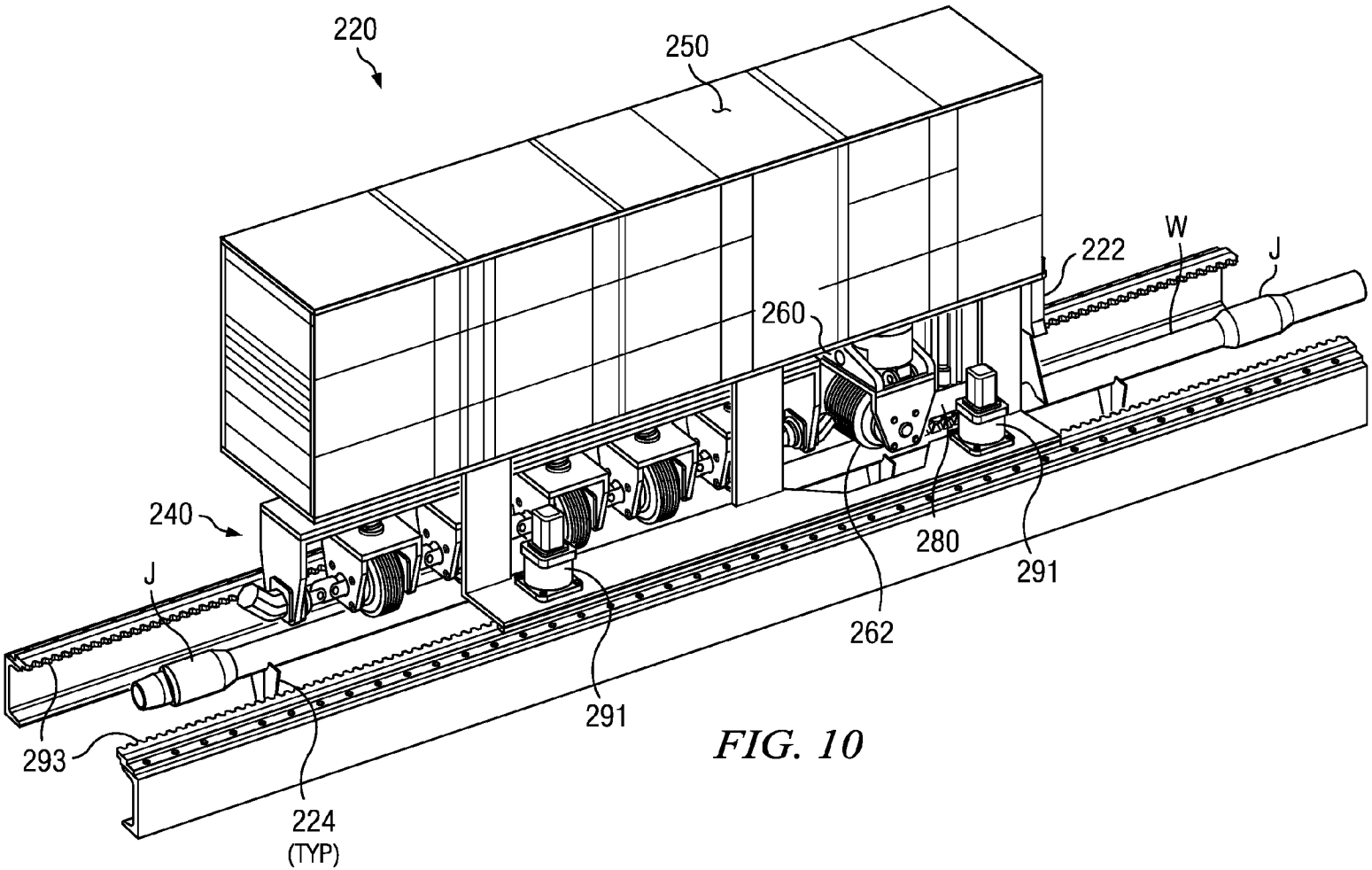
FIG. 10 is a further isometric view of ODS embodiment of FIGS. 5-7, with a propulsion drive and track detail added.

FIG. 6 also illustrates exemplary propulsion structure for ODS assembly 220. It will be appreciated that ODS assembly may be propelled back and forth above the external surface of a stationary but rotating tubular by any conventional method and/or structure. The propulsion structure illustrated on FIG. 6 (and elsewhere in FIGS. 5 though 13B) is by way of example only. FIG. 6 illustrates ODS propulsion motors 291 deployed either side of ODS assembly 220. Propulsion motors 291 may be any conventional power apparatus (such as hydraulic, electric or pneumatic motors). Propulsion motors 291 rotate roller pinions 292, which in turn are engaged on geared tracks 293. Note that on FIG. 6, geared tracks 293 may only be seen in section. However, with momentary reference to FIG. 10, geared tracks 293 may be seen in isometric view from above. FIG. 10 also illustrates propulsion motors 291, although roller pinions 292 are hidden from view on FIG. 10. It will be further appreciated from FIGS. 6 and 10 that in the embodiments of ODS assembly 220 illustrated and described, an example of four (4) propulsion motors 291 propel ODS assembly 220 up and back along two (2) geared tracks 293. This disclosure is not limited in this regard, however, and other embodiments may deploy other numbers of propulsion motors 291 in various configurations on various numbers of geared tracks 293, per user design. Although not illustrated in detail on FIGS. 6 and 10, it will be understood that the travel of ODS assembly 220 is further kept in a straight line parallel to the longitudinal axis of a tubular beneath by bearings and related conventional structure rolling on and between guide rails.

It will be also understood from FIGS. 6 and 10 that the operation of propulsion motors 291 may be controlled closely to allow a high level of corresponding control over the movement (and speed thereof) of ODS assembly 220 above a rotating tubular. Movement may be directed at any time, per user control, in a forward or backward direction at user-selected speeds. Such control over movement of ODS assembly 220 (and corresponding control over ODS operations) may be combined with control over concurrent internal tubular (MLI) operations and over rotation of the tubular to give a highly controlled cleaning, inspection and/or data analysis of the tubular at an enterprise level.

Figure 7:
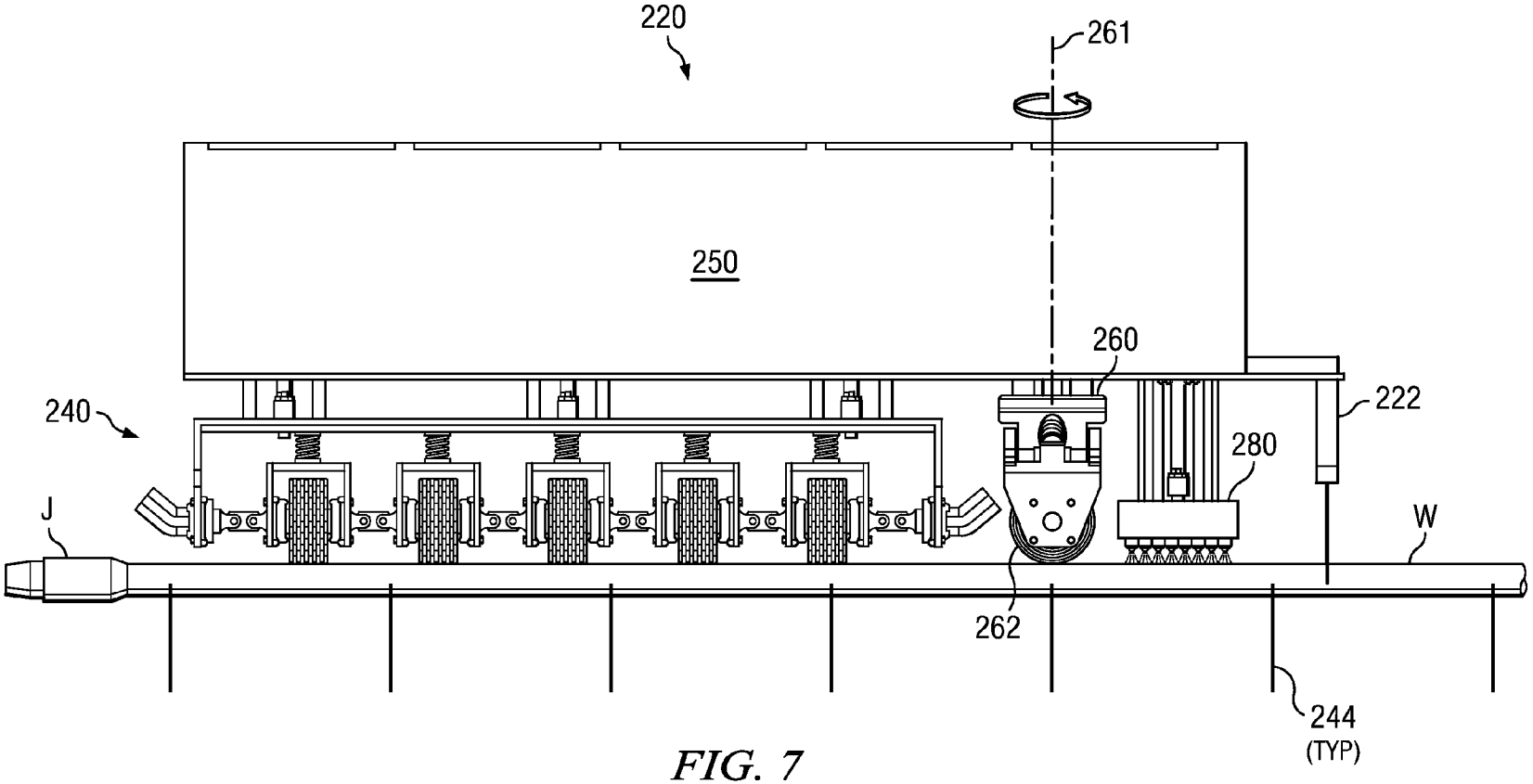
FIG. 7 illustrates the ODS embodiment of FIG. 5 disposed to operate on tubular W.
Figure 8:
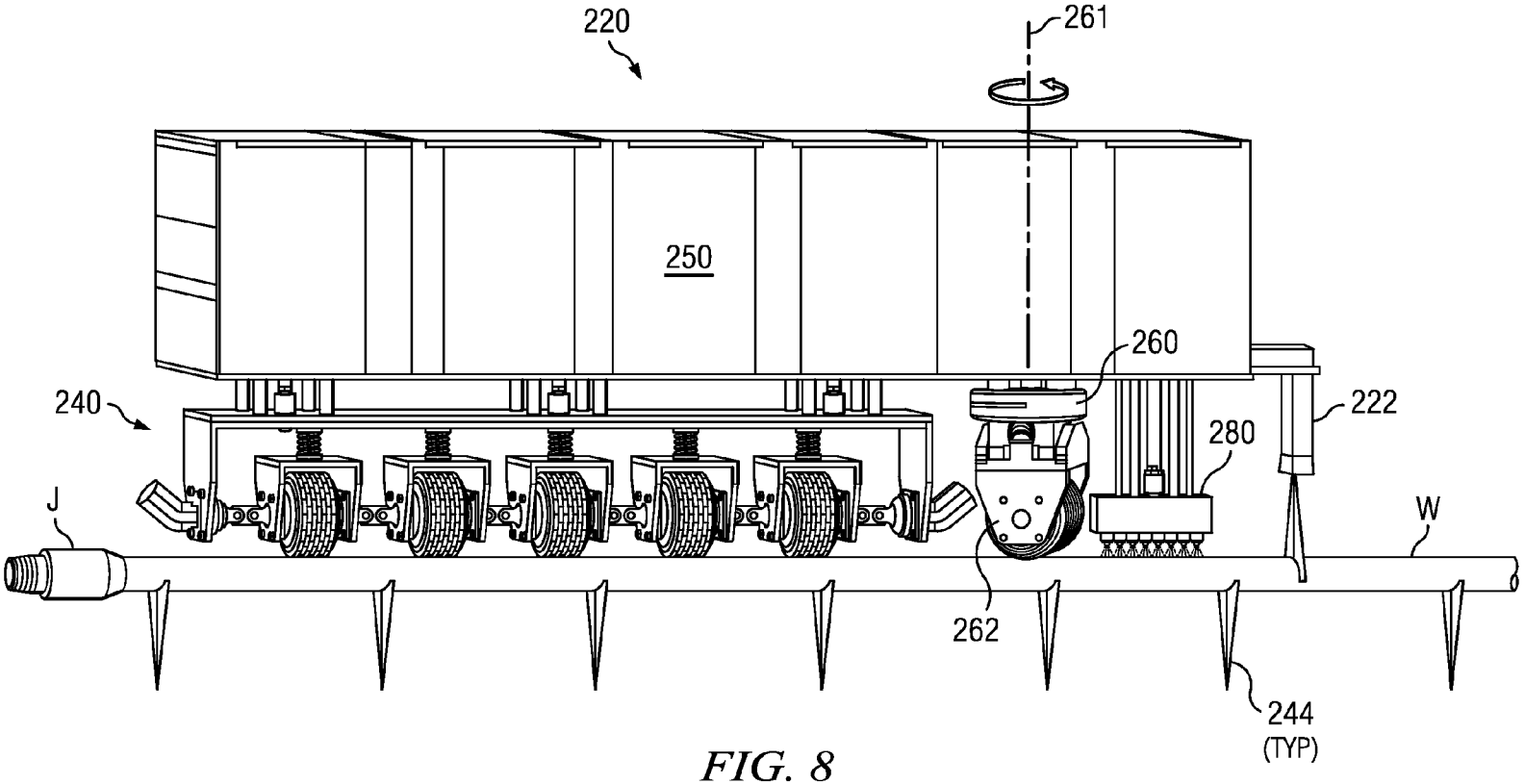
FIGS. 8 and 9 illustrate the ODS embodiment of FIGS. 5-7 in different isometric views.
Figure 9:
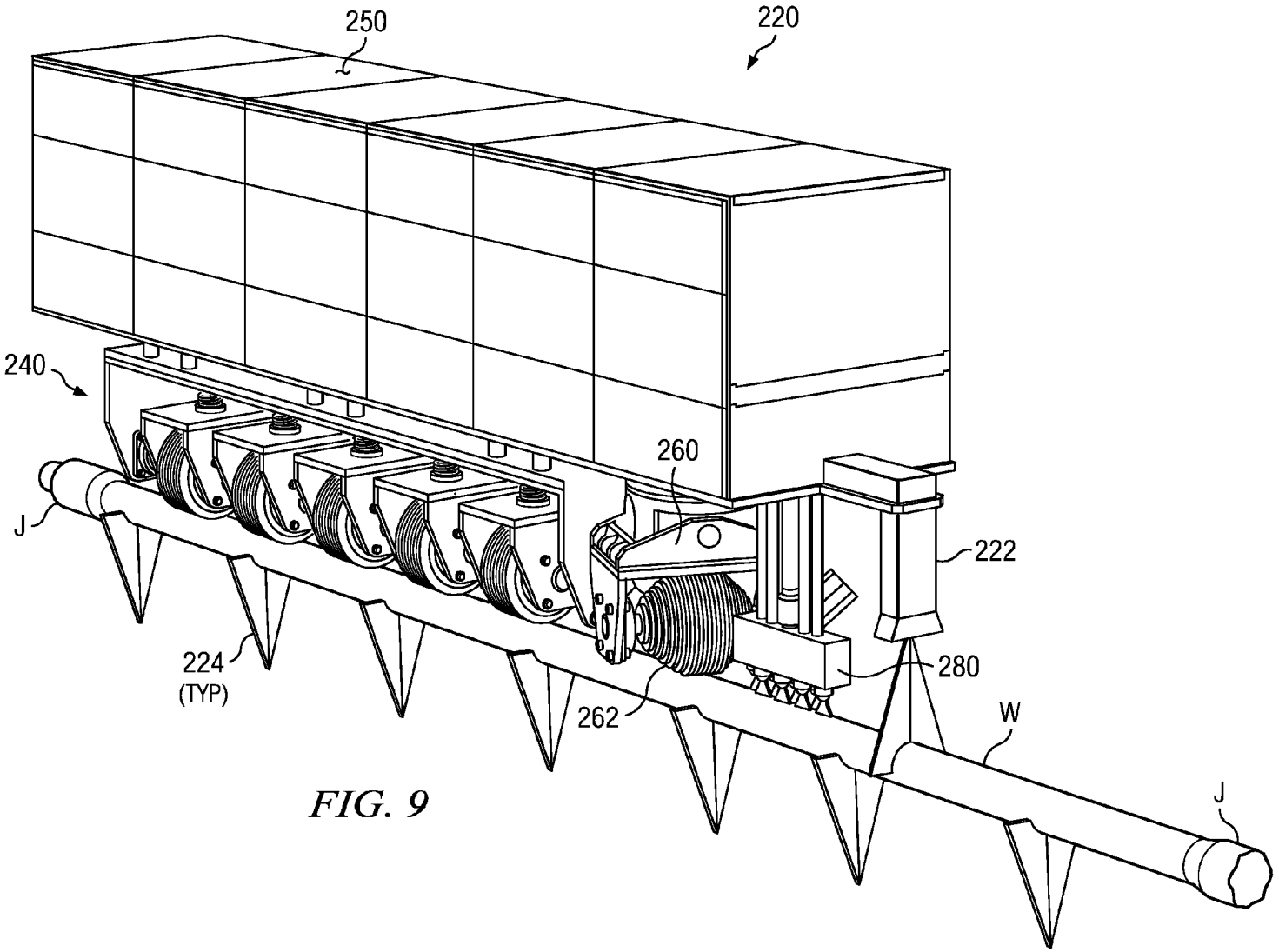

Reference is now made to FIGS. 7, 8 and 9 together. FIGS. 7, 8 and 9 illustrate substantially the same structure from different views. FIG. 7 is an elevation view. FIGS. 8 and 9 are isometric views from different angles.

FIGS. 7, 8 and 9 depict ODS assembly 220 in substantially identical form to ODS assembly 220 as depicted on FIG. 5 (including ODS laser 222, fluid jet assembly 280, swivel brush assembly 260, fixed brush train 240 and top shroud 250), except that on FIGS. 7, 8 and 9 also depict rotating tubular W beneath ODS assembly 220 and on which ODS assembly is operating. Tubular W includes at least one joint J. FIGS. 7, 8 and 9 further depict fixed lasers 224 beneath tubular W, whose fields of view scan the underside of tubular W as it rotates. It will be understood that fixed lasers 224 are stationary in user-selected fixed locations. Information gained from scans of fixed lasers 224 is advantageously combined with laser and optical camera information from ODS laser 222 as it moves back and forth above tubular W and coincides with (co-locates with) individual fixed lasers 224. The processing and use of laser and optical camera information is discussed in greater detail below.

All the disclosure above describing aspects and features of ODS 220 with reference to FIGS. 5 and 6 applies equally to ODS 220 as depicted on FIGS. 7, 8 and 9. With particular reference to swivel brush assembly 260, it will be seen on FIGS. 8 and 9 that swivel brush assembly 260 has been rotated about vertical swivel brush assembly axis 261 (shown on FIGS. 7 and 8) so that the plane of rotation of swivel brush 262 is at an angle to the longitudinal axis of tubular W. Referring back to disclosure associated with FIGS. 5 and 6, such rotation allows swivel brush 262 to take up a user-selected angle of attack when abrading the external surface of rotating tubular W, to account for features such as, for example, surface defects, helical wear patterns or discontinuities in diameter (such as at pipe joints J, described in more detail immediately below) on tubular W.

Pipe joints J illustrated on FIGS. 7, 8 an 9 illustrate examples of the variations in local contour and diameter that ODS assembly 220 may encounter during its travel back and forth while operating on the external surface of tubular W. Other changes in contour may be caused by, for example (and without limitation), bow or sag in tubular W, local out-of-roundness in the diameter of tubular W, or excessive wear, scarring or pitting at local points. As noted in earlier disclosure with reference to FIGS. 5 and 6, ODS assembly 220 is disposed to account for such local variations in contour and diameter of tubular W via articulated brush joints 244 and shock absorbers 248 on fixed brush train 240 (described in more detail below with reference to FIG. 11), and via tilting springs 264 and related structure on swivel brush assembly 260 (described in more detail below with reference to FIGS. 12A through 12E).

Propulsion features and aspects illustrated on FIG. 10 (including propulsion motors 291 and geared tracks 293) have already been described in association with earlier disclosure making reference to FIG. 6. Other features and aspects of ODS assembly 220 illustrated on FIG. 10 are substantially as also described above with reference to FIGS. 5 through 9. Features illustrated on FIG. 10 that are also illustrated on FIGS. 5 through 9. carry the same numeral throughout.

Figure 11:
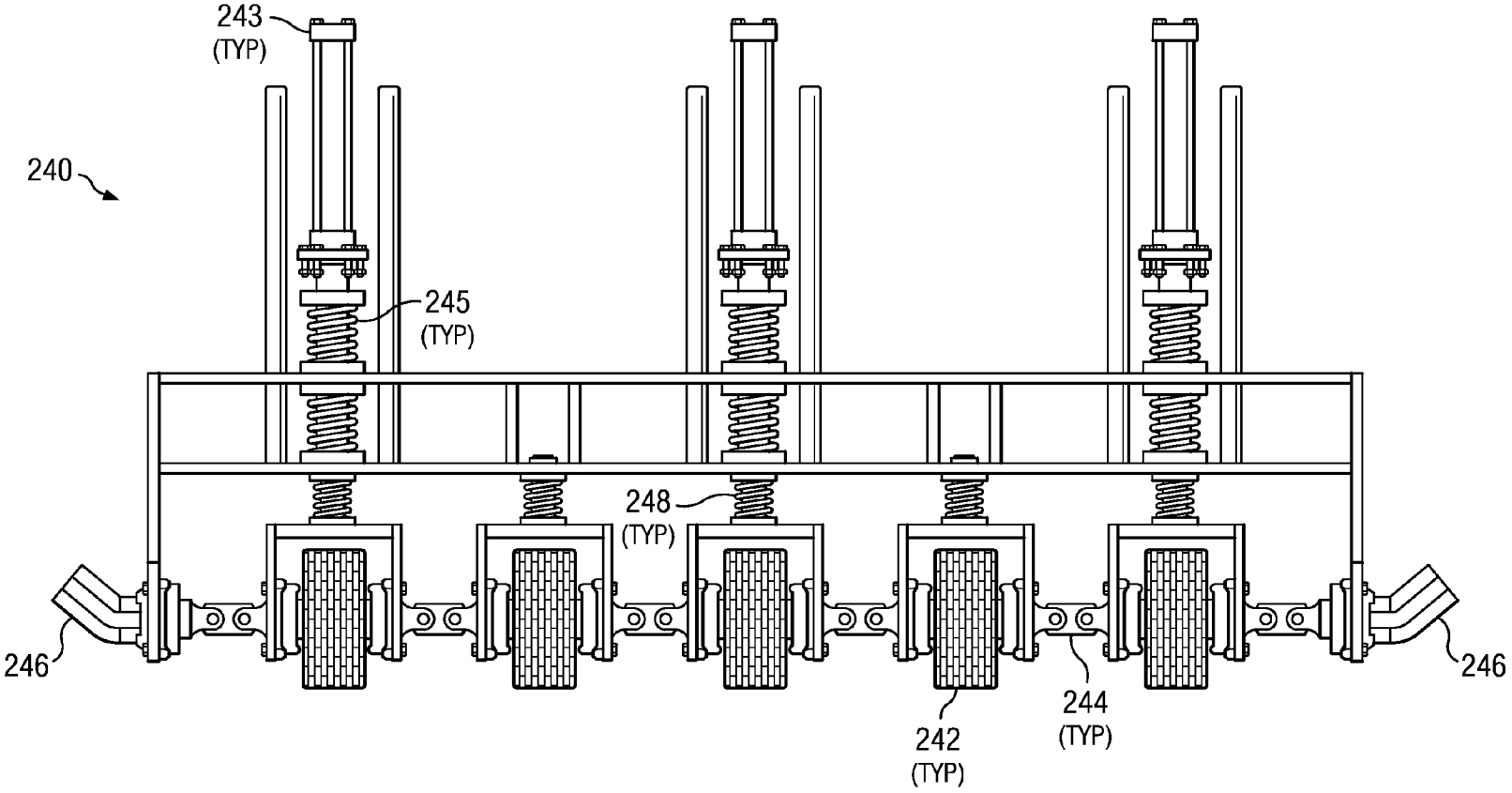
FIG. 11 is an isolated elevation view of fixed brush train 240.

FIG. 11 illustrates additional features of fixed brush train 240 from FIGS. 5 through 10, with some enlargement and in isolation, and with top shroud 250 removed. All earlier disclosure regarding fixed brush train 240 with reference to FIGS. 5 through 10 applies equally to FIG. 11. It will be recalled from such earlier disclosure that the concatenation of articulated brush joints 244 forms an articulated drive shaft for fixed brushes 242 driven by fixed brush motors 246 at either or both ends thereof. The articulated nature of the connections between fixed brushes 242 allows for semi-independent vertical movement of individual fixed brushes 242 while still permitting fixed brush motors 246 to rotate all fixed brushes 242 in unison. It will be further recalled that shock absorbers 248 further regulate the semi-independent vertical movement of individual fixed brushes 242 to enable fixed brushes 242 to maintain contact with the external surface of a tubular below despite local variations in tubular contour or tubular diameter.

FIG. 11 further illustrates fixed brush train lifts 243 for setting fixed brush train 240 at a general height above a tubular, according to user-selection. Fixed brush train lifts 243 may be any conventional lifting mechanism, such as a hydraulically-actuated cylinder, as illustrated on FIG. 11. It will be appreciated that fixed brush train lifts 243 may be actuated to set a desired elevation for fixed brushes 242 with respect, for example, to a desired amount of brush pressure on a tubular having a nominal diameter. Fixed brush train lifts 243 actuate against fixed brush train lift springs 245 in order to provide spring resistance to the actuation of train lifts 243. This spring resistance assists with smooth and precise actuation, which in turn assists with smooth and precise application of brush force by fixed brushes 242 on an expected nominal diameter tubular. As noted above, variations in local contour or diameter of the tubular may then be accounted for by semi-independent vertical movement of individual fixed brushes 242 provided by articulated joints 244 and shock absorbers 248.

It will be further appreciated from FIG. 11 that fixed brush lifts 243 are not limited to setting an elevation for fixed brushes 242 that is parallel to the longitudinal axis of the tubular. Angles for fixed brush train 240 may be set such that fixed brushes 242 may apply greater pressure to the tubular at one end rather than the other. It will also be understood that this disclosure is not limited to deploying three (3) fixed brush train lifts 243 on one installation, as illustrated on FIG. 11. The example of FIG. 11 is suitable for the exemplary fixed brush train 240 embodiment also illustrated on FIG. 11 with five (5) fixed brushes 242. Other embodiments of fixed brush train 240 may deploy more or fewer than two (3) fixed brush train lifts 243, and this disclosure is not limited in this regard.

Figure 12A:
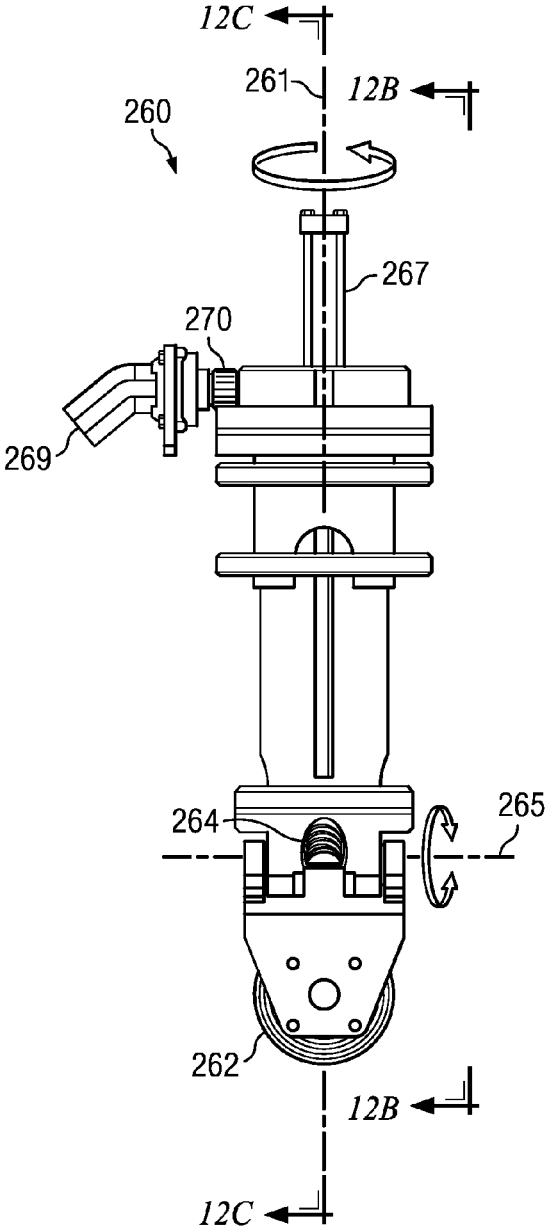
FIGS. 12A and 12B are isolated elevation views of swivel brush assembly 260.
Figure 12B:
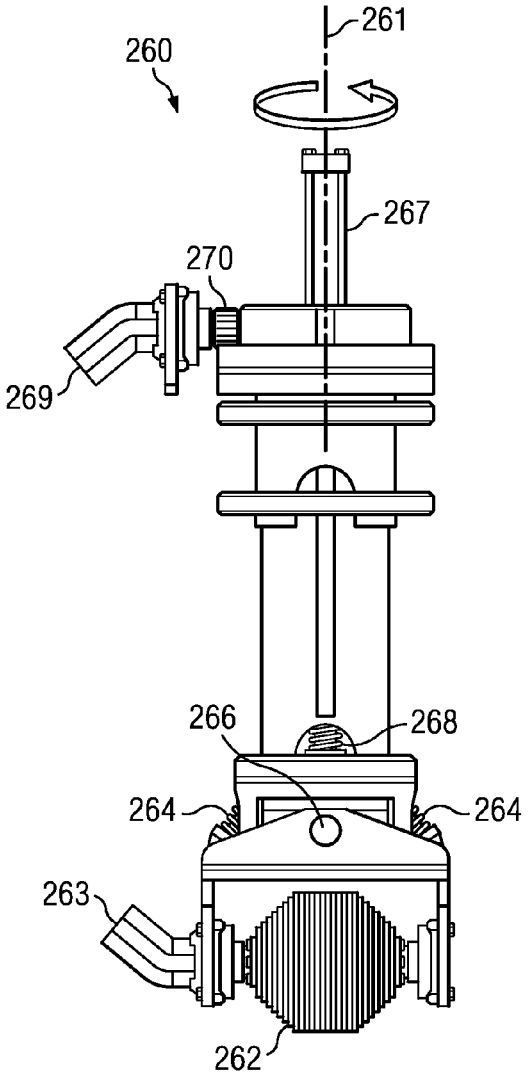
Figure 12C:
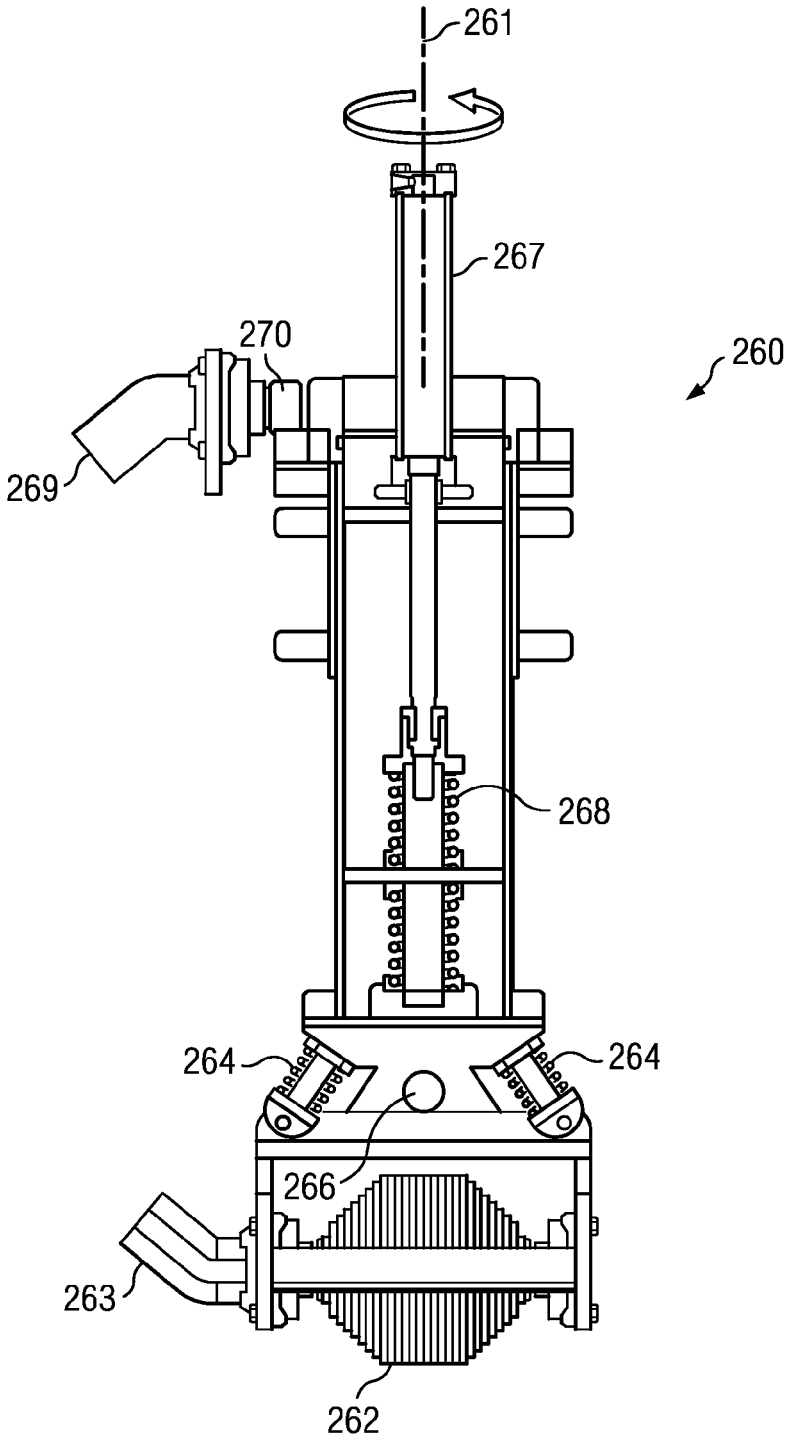
FIG. 12C is a cutaway view of swivel brush assembly 260.

FIGS. 12A through 12E should be viewed together. FIGS. 12A through 12E illustrate additional features of swivel brush assembly 260 from FIGS. 5 through 10, with some enlargement and in isolation, and with top shroud 250 removed. FIG. 12B is an elevation view of swivel brush assembly 220 as shown on FIG. 12A. FIG. 12C is a cutaway view of swivel brush assembly 220 also as shown on FIG.

12A. All earlier disclosure regarding swivel brush assembly 260 with reference to FIGS. 5 through 10 applies equally to FIGS. 12A through 12E. It will be recalled from such earlier disclosure (in particular with reference to FIGS. 5 and 6) that swivel brush 262 may be set to rotate and abrade at an angle to the longitudinal axis of a tubular beneath, per user selection via rotation of swivel brush assembly 262 about vertical swivel brush axis 261. It will also be recalled from earlier disclosure that illustrated embodiments of swivel brush assembly 260 deploy swivel brush 262 with an oblate spheroid (colloquially, "football") shape and profile for advantageous performance over variations in the tubular's local contour and diameter.

Earlier disclosure also described a "tilt" (or pivot) feature on swivel brush assembly 260 to assist swivel brush 262 in maintaining brush pressure while following the local contour of a rotating tubular beneath. FIGS. 12A through 12E describe the tilting feature in more detail. Referring to FIGS. 12A through 12E, tilting is about swivel brush assembly tilting axis 265 on FIG. 12A, also represented by pivot 266 on FIGS. 12B and 12C. Such tilting will thus be seen to be about a substantially horizontal axis. Tilting is regulated by tilting springs 264, seen on FIG. 12B to hold swivel brush 262 (and connected structure) in spring equilibrium about pivot 266. In this way, once the general height of swivel brush assembly 260 above a tubular is set, tilting springs 264 allow swivel brush 262 to tilt about pivot 266 as it encounters local variations in the contour or diameter of the tubular beneath, During such tilting, responsive to compression pressure from tilting springs 264, swivel brush 262 may still maintain a substantially constant contact on the surface of the tubular.

FIGS. 12A through 12E further illustrate swivel brush assembly lift 267 for setting swivel brush assembly 260 at a general height above a tubular, according to user-selection. Swivel brush assembly lift 267 may be any conventional lifting mechanism, such as a hydraulically-actuated cylinder, as illustrated on FIGS. 12A through 12B. It will be appreciated that swivel brush assembly lift 267 may be actuated to set a desired elevation for swivel brush 262 with respect, for example, to a desired amount of brush pressure on a tubular with nominal diameter below. As shown best on FIG. 12C, swivel brush assembly lift 267 actuates against swivel brush assembly lift spring 268 in order to provide spring resistance to the actuation of swivel brush assembly lift 267. This spring resistance assists with smooth and precise actuation, which in turn assists with smooth and precise application of brush force by swivel brushes 262 on an expected nominal diameter tubular. As noted above, variations in local contour or diameter of the tubular may then be accounted for by tilting springs 264 holding swivel brush 262 in spring equilibrium about pivot 266.

FIGS. 12A through 12E further illustrate structure to enable controlled rotation of swivel brush 262 about vertical swivel brush axis 261, further to more general disclosure above regarding such rotation. Swivel rotation motor 269 on FIGS. 12A through 12E operates swivel rotation gears 270 to rotate swivel brush 262 about axis 261. Swivel rotation motor 269 may be any conventional power apparatus (such as a hydraulic, electric or pneumatic motor) to power-rotate swivel brush 262 about axis 261 per user control.

Figure 12D:
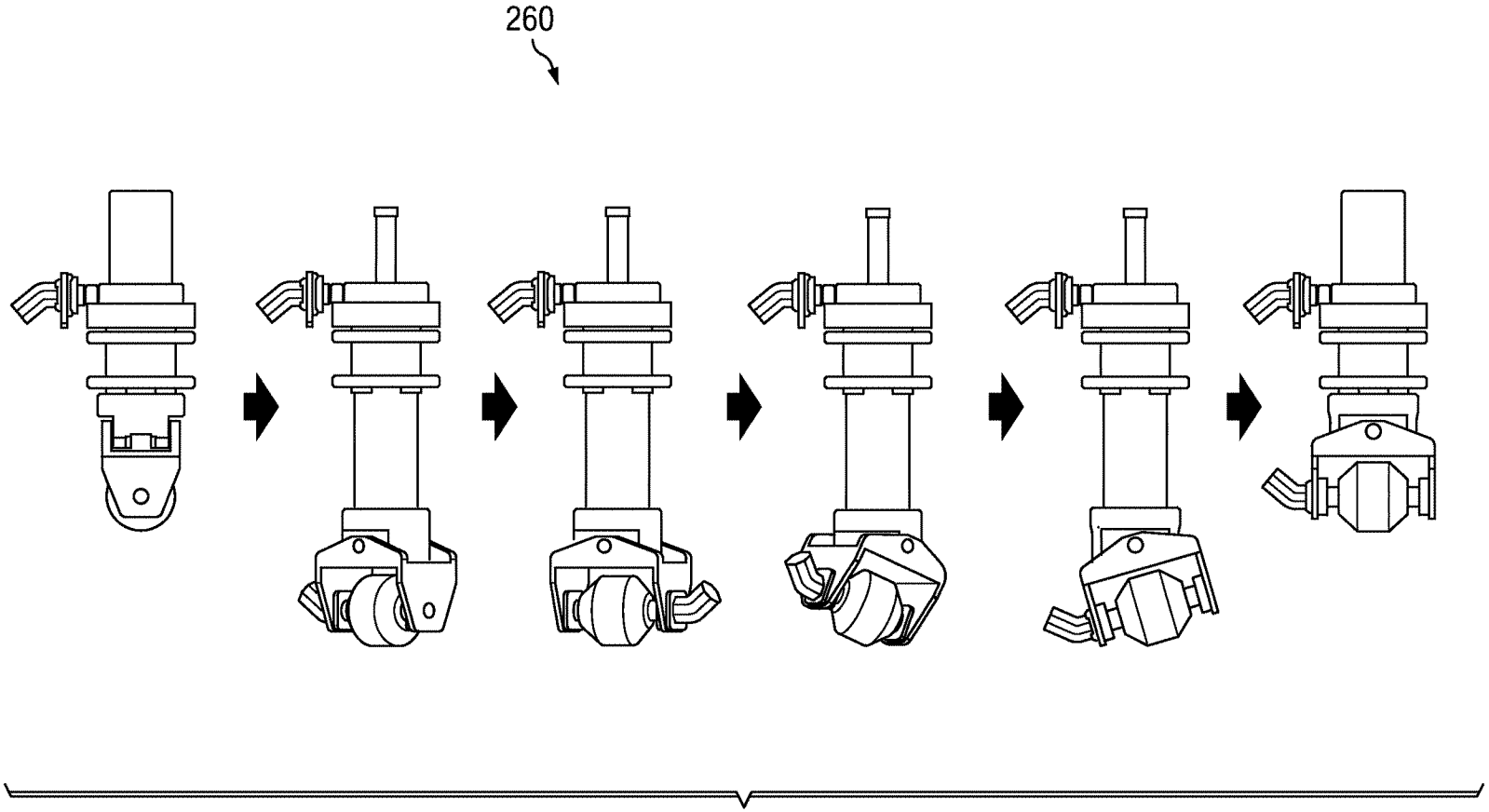
FIGS. 12D and 12E are stroboscopic views of swivel brush assembly 260.
Figure 12E:
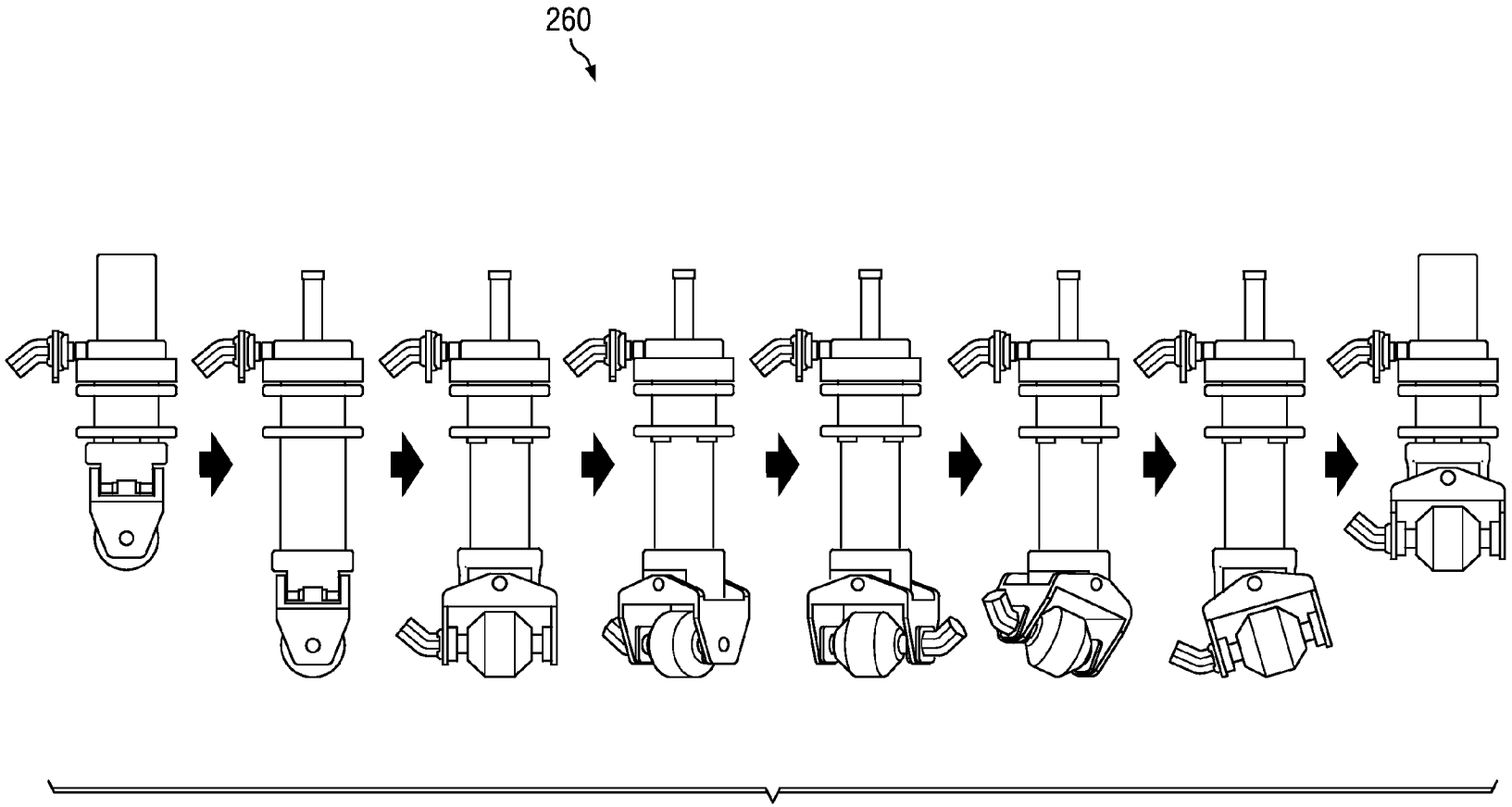

FIGS. 12D and 12E illustrate, in stroboscope or "freeze-frame" style, the various motions available to swivel brush assembly 260 during normal operation. FIGS. 12D and 12E illustrate (with further reference to FIGS. 12A through 12C): (1) actuation of swivel brush assembly lift 267 to set a general height for swivel brush 262, (2) rotation of swivel brush 262 about vertical swivel axis 261, and (3) tilting of swivel brush 262 about pivot 266.

Figure 13A:
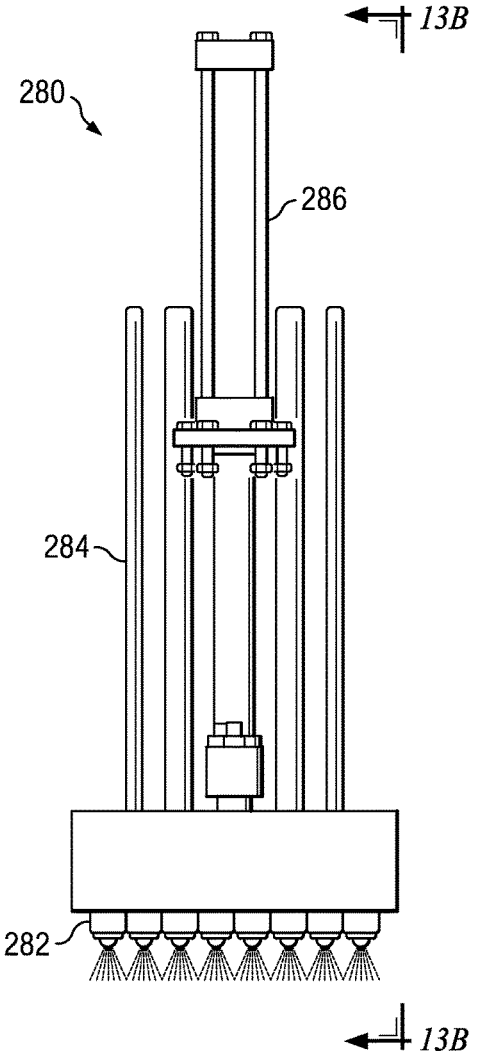
FIGS. 13A and 13B are isolated elevation views of fluid jet assembly 280.
Figure 13B:
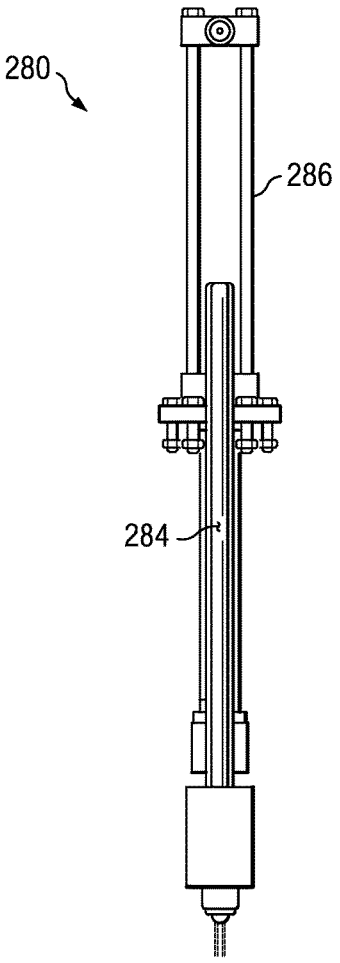

FIGS. 13A and 13B should be viewed together. FIGS. 13A and 13B illustrate additional features of fluid jet assembly 280 from FIGS. 5 through 10, with some enlargement and in isolation, and with top shroud 250 removed. FIG. 13B is an elevation view of fluid jet assembly 280 as shown on FIG. 13A. All earlier disclosure regarding fluid jet assembly 280 with reference to FIGS. 5 through 10 applies equally to FIGS. 13A and 13B. It will be recalled from such earlier disclosure (in particular with reference to FIG. 5) that fluid jet assembly 280 provides jets 282, which spray or blast fluids (in gaseous or liquid state) onto the external surface of a rotating tubular beneath. Individual jets 282 are user-selectable according to operational needs.

FIGS. 13A and 13B further illustrate fluid jet assembly lift 286 for setting fluid jet assembly 280 at a general user-desired height above a tubular. Electronic control systems then, on the fly, make small changes in the elevation of jets 282 above the external surface of the tubular by actuating jet height control cylinders 284. In this way, a user-selected distance between jets 282 and the external surface of the tubular may be maintained, notwithstanding local variations in contour or diameter of the tubular that jets 282 may encounter during their travel along the length of the tubular.

The electronic control systems described above (for maintaining distance between jets 282 and external surface of tubular) utilize real time information regarding the tubular collected by ODS laser 222. Referring back to earlier disclosure associated with FIGS. 5 through 9, it will be recalled that as ODS assembly 220 travels back and forth above a rotating tubular, ODS laser 222 scans the external surface of the tubular. It will be further recalled that in currently preferred embodiments, ODS laser 222 includes both a laser and an optical camera to scan the external surface of the tubular. Laser scans by ODS laser 222 may identify contours and external surface anomalies on the tubular of all types in real time, including surface defects (such as, for example, scratches, gouges, divots, pitting, and laminations), as well as larger variations in tubular diameter diameter such as pipe joints. Such laser scan data regarding the external surface of the tubular is also referred to in this disclosure as "contouring data" or "contour data", and is derived from laser data but not optical camera data. As will be described in greater detail below, contour data derived solely from laser scans is used for operational cleaning purposes (including for adjusting the height of fluid jet assembly 280, swivel brush assembly 260 and fixed brush train 240 above the tubular's surface) as well as for inspection purposes. On the other hand, optical camera data is used in combination with laser data from ODS laser 222, and further in combination with data from fixed lasers 224 beneath the tubular, in order to derive dimensional data regarding the outside diameter ("OD") of the tubular for inspection purposes. The advantages of optical camera data, and the use thereof in deriving OD dimensional data, are also discussed in more detail below.

Returning now to further consideration of contour data derived from laser scans (only) by ODS laser 222, it will be appreciated that substantial information regarding the contours of a tubular may be obtained. Given knowledge (1) of the absolute position of ODS laser 222 on a tubular at a particular moment in time, and (2) of the rotational speed of the tubular at such moment in time, ODS laser 222 may "map" the contours over the entire external surface of the tubular. Knowledge of the absolute position of ODS laser 222 may be obtained via methods that include (1) knowing when ODS laser 222 first encounters the tubular as it begins its first pass over the tubular, and (2) establishing relative position to the "first encounter" from sensors, such as optical sensors, deployed in the propulsions system (such as in, or attached to, roller pinions 292 and/or geared tracks 293 as illustrated and described above with reference to FIGS. 6 and 10). It will be appreciated that such optical sensors may conventionally translate measured speed and direction of travel of ODS assembly 220 into a position relative to the "first encounter".

Further consideration will now be given to data regarding the OD of the tubular derived for inspection purposes from both laser and optical camera data from ODS laser 222 (on FIGS. 5 through 10), in combination with laser data from fixed lasers 224 (on FIGS. 7 through 10). Such laser and optical camera data may be combined to obtain real time "caliper"-type measurements of the tubular at intervals along the tubular's length. Combined and coordinated laser data and optical camera data from ODS laser 222 and fixed lasers 224 may enable dimensional irregularities or anomalies in the tubular (such as sag, wobble or bow in the tubular, or areas where the tubular is out-of-round) to be identified and location-tagged along the tubular's length. This "caliper"-type data may be used in real time to correct (via adjustment and compensation): (1) overall dimensional data regarding the OD of the tubular and any point along its length, as well as (2) contour data obtained from laser data from ODS laser 222 as described in the immediately preceding paragraphs.

It is useful to highlight some of the aspects and advantages in combining optical camera data with laser data in obtaining information about the OD of the tubular, or "pipe" as used in the following optical camera discussion. Determining the outside diameter of a drill pipe optically is a challenge. As an object moves closer or farther from a fixed zoom lens, it grows and shrinks respectively. For measurement purposes on pipes of varying diameters and centerlines, simply taking a picture and determining the size of a pipe is not practical. However, the combined use of an optical lens with a range finding laser adds the axis of reference necessary to account for the varying centerline distances and calculation of diameters possible.

In order to achieve a pipe diameter measurement, an image is taken of the pipe using a line scan camera. The line scan camera captures a slice of the pipe. This slice contains a one dimensional array of information, essentially containing 'material' and 'non-material'. The 'material' being pipe, the "non-material" representing anything outside the pipe. The differentiation between the two is made using threshold values on the grayscale information contained in the array. For instance, given a grayscale color spectrum of 8 values, non-material may be any value below 3, while material would show 4 through 8. With the combination of a light source and a filter on the lens, only the light reflecting off pipe material will be allowed into the camera. This will allow for a fine resolution between "material and "non-material" and for fast image processing and information output.

Now, a calculation of the number of "material" pixels in the array divided by (material+non-material) pixels will give the percentage material in any particular slice of information. Without a frame of reference, this number is useless. However, the combination of this percentage with a range finding laser at each point a slice is taken allows for accurate calculation of length based on percentage of material.

As an example, if at 1 inch away from the lens, an image contains 50% material and the known size of the pixel array at 1 inch away is 1 inch, the object size may be calculated to be 0.5 inches. Taking this one step further, if at 10 inches away from the lens the pixel array is known to contain 10 inches of information, an image containing 5% material pixels will also be 0.5 inches. Now, using this concept in combination with a range finding laser and careful calibrations of the pixel array size to distance ratio, an image, or slice of a pipe, can be used to very accurately calculate diameter based on simply the data contained in a slice and the reference distance the lens is from the pipe, which is provided by the range finding laser.

Using a high scan rate and high resolution camera, very accurate calculations can be made as to the diameter of the pipe. Combining multiple line scan cameras will multiply the accuracy. This system will traverse the length of the pipe, taking slices of information quickly and accurately and allow for a novel way to determine pipe diameter information.

Returning now to consideration of contour data, it will thus be appreciated that contour data regarding the tubular acquired by laser scans by ODS laser 222 (and preferably corrected with "caliper"-type data) may then be fed in real time to control systems on other operating systems on ODS assembly 220. Such real time contour data may then be used to make corresponding adjustments to the operating systems. For example, and without limitation; such real time contour data may be used to make corresponding adjustments that include: (1) adjusting the distance between jets 282 and the external surface of the tubular in order to maintain a constant distance therebetween; (2) adjusting the angle of attack of swivel brush 262 in order to obtain optimum abrasion; (3) adjusting the general elevation of swivel brush assembly 260 or fixed brush train 240 in order to accommodate a large tubular diameter change such as a pipe joint; (4) adjusting the speed or direction of rotation of swivel brush 262 or fixed brushes 242 according to upcoming conditions; or (5) adjusting the speed or direction of travel of ODS assembly 220 according to upcoming conditions.

It is useful to highlight some of the advantages of maintaining a constant distance between jets 282 and the external surface of the tubular, notwithstanding local contour or diameter variations in the tubular. If jets 282 are too close to the tubular's external surface, even momentarily, then damage to the tubular's surface (such as steel erosion and cutting) may occur, especially during high pressure fluid blast cycles. Such damage occurs substantially immediately if the right conditions exist. On the other hand, if jets 282 are too far away, again even momentarily, then fluid jet assembly 280's operations (such as cleaning, rinsing, coating, drying, etc.) may be less than fully effective, and possibly compromised. As distance between jets 282 and the tubular's surface increases, operating effectiveness decreases exponentially.

It is therefore highly advantageous to maintain an optimal distance between jets 282 and the external surface of the tubular, so that the operating effectiveness of jets 282 is maximized without causing damage to the tubular's surface. The electronic control system using data that includes real time contour data obtained by laser data from ODS laser 222, as described above, is useful to maintain that optimal distance.

It will be further appreciates that the ODS contour data acquisition and processing system, and related electronic control systems, described in the preceding paragraphs, may also be combined and coordinated in real time with concurrent data regarding the internal surface and diameter of the tubular. Exemplary internal data acquisition structure and technology is described in U.S. Provisional Application Ser. No. 61/707,780 (to which provisional application this application claims priority). Such concurrent data may supplement ODS contour data to provide additional information regarding the tubular in real time, including, for example, tubular wall thickness information and further analysis of points of interest such as apparent cracks, etc.

It may be advantageous in ODS operations to acquire ODS contour data in a first pass over the tubular, and then return (or go back on a second pass) for more information. Further data regarding the OD of the tubular may be gathered in order to prepare a summary thereof. Additionally further investigation may be conducted on points of interest (such as cracks, pitting, gouges, etc.) identified and location-tagged on a previous pass. Second- (or subsequent-) pass investigations may call for the ODS to pass by points of interest more slowly; or at a different tubular rotation speed, than might be optimal for cleaning operations on an previous pass.

The following sections of this disclosure now focus a mechanical inspection data acquisition system useful in conjunction with the ODS technology also disclosed herein. The ODS contour data acquisition and processing system, and related electronic control systems, described in the preceding paragraphs, dovetail into the disclosed mechanical inspection Data Acquisition System ("DAS"). The following DAS disclosure should also be read in conjunction with MLI disclosure in U.S. Provisional Application Ser. No. 61/707,780 (to which provisional application this application claims priority). Note, however, that although disclosed as part of the Scorpion System, the DAS technology could be used independently in many tubular processing operations. It is not limited to deployment on a tubular cleaning system.

Conventional technology calls for pipe joints and other tubulars to receive regular EMI (Electro-Magnetic Inspection or equivalent nomenclature) analysis to check the integrity of the joint. EMI analysis provides data, ideally in a graph format, interpretable to see, for example, if the tubular's wall thickness has fallen below a certain acceptable thickness at any point, or if the tubular has any unacceptable defects such as pits or cracks.

EMI is conventionally provided by passing electromagnetic sensors over a stationary tubular, such as a joint of drill pipe. Alternatively, the tubular can be conventionally passed over a stationary electromagnetic sensor apparatus. This operation can be done in the shop or in the field. If an anomaly is found, the EMI sweep operation has to stop in order to pinpoint the anomaly. Further analysis is then done manually at the site of the anomaly (usually sonic analysis) to determine whether the pipe joint is in or out of specification. In some embodiments of the ODS, an EMI sweep operation may be configured by deploying an EM "donut" ring on ODS assembly 220 as shown on FIGS. 5 though 10. The donut ring may sweep the tubular as ODS assembly 220 moves up and back above the rotating tubular.

The Scorpion System's DAS is an optional add-on to the other aspects of the Scorpion System disclosed elsewhere in this disclosure. The DAS provides sensors at suitable locations (such as, without limitation, on drift tooling or dedicated sensor lances on the MLI, or on the insides of shrouds or on a dedicated probe head on some embodiments of the ODS according to FIGS. 1 through 4, or as recorded by laser(s) and optical camera(s) onboard ODS laser 222 and by fixed lasers 224 on other embodiments of the ODS according to FIGS. 5 through 10). These sensors are provided to analyze the state of the rotating tubular. A further particularly advantageous sensor placement (without limitation) would be to locate a resistivity tool in an internal drift.

The DAS sensors may be of any suitable type for inspecting the tubular. The DAS sensors may be, for example, electromagnetic sensors, sonic sensors, lasers, cameras (still or video, optical or otherwise) accelerometers, or any other type of sensor, and the DAS is expressly not limited in this regard. Examination of the tubular by the sensors may be done at the same time that cleaning operations are done, or alternatively during separate inspection passes of the MLI or the ODS along the tubular.

It will be appreciated that the DAS may be enabled by any suitable data acquisition system capable of taking multiple sensor readings at high sampling rates, and then converting those readings into human-interpretable qualitative and quantitative data regarding the sampled specimen. Such data acquisition systems are well known in the art. The software also compares the sampled data with stored data, again in real time. As will be described in further detail below, the stored data may include, for example, earlier inspections of the same specimen, or paradigms such as theoretical scans of a specimen that meets applicable performance specifications.

A primary principle of the DAS is to acquire, in real time, sufficient data regarding the state of a tubular to have generated a unique and highly-individualized data "signature" of the tubular representing its current state as sampled. The signature represents any recorded and repeatable combination of sampled information points regarding the state of the tubular. Such sampled information points may include, by way of example and without limitation, qualitative and quantitative data regarding:

(a) location, shape and nature of anomalies on interior and/or exterior walls of tubular (such as scratches, scars, pits, gouges, repairs or cuts from prior service, or manufacturing defects of a similar nature);

(b) location and nature of variations in wall thickness of tubular;

(c) location and nature of variations in cross-sectional shape of the tubular; or (d) location and nature of cracks or other points of weakness within the tubular.

The foregoing data is advantageously in high resolution. The more sampled information points regarding a tubular are combined into a signature, the more unique and highly-individualized the signature is likely to be. It will be appreciated that the "sample-richness" or "granularity" of the DAS signature of a tubular may be further enhanced by combining synchronous sampling of the exterior and interior of the tubular. One option for data acquisition in an illustrated embodiment of the Scorpion System is for an MLI lance with data acquisition capability and the ODS probe head or laser (as described elsewhere in this disclosure) to be run synchronously down the tubular with all such sensors (internal and external) being in data communication with each other. In this way, the DAS may acquire real time data regarding the tubular in which the data quality is enhanced by concurrent and substantially co-located sampling from both sides of the wall of the tubular. The DAS software and hardware is configured to allow a user to zoom in on points of interest on a graphical display in order to classify and measure anomalies.

A further feature in preferred embodiments of the DAS is a "stop/start curtain" that may be provided on embodiments of the ODS. The stop/start curtain is particularly advantageous in embodiments of the Scorpion System where "synchronous" examination (as described above) of the interior and exterior of the tubular is available. However, the curtain feature is not limited to such embodiments. The curtain feature refers to one or more sensors placed on each end of the ODS, and may use the optical range to be in the form of a "light" curtain. These sensors detect when the tubular is present underneath, and when it is not. The sensors may be lasers or lights (hence the colloquial reference to a "curtain") or any other sensor capable of such detection. As the ODS moves toward the tubular to commence operations, the curtain at the near end of the ODS detects the end of the tubular and synchronizes/coordinates DAS processing to this event. As the ODS nears completion of its travel over the tubular, the curtain at the near end of the ODS detects the end of the tubular and warns the DAS of this event. The curtain at the far end of the DAS eventually detects the end of the tubular and notifies that DAS that a full sweep of the tubular has been completed. It will be appreciated that the curtain feature may then be operated in reverse for a pass of the ODS along the tubular in the opposite direction.

Once acquired, the signature of the tubular may then be compared with the expected corresponding signature of a paradigm. The paradigm may be anything from the expected signature of a brand new, perfectly-manufactured tubular (the "perfect pipe"), to the expected signature of a tubular that meets all applicable performance specifications for the tubular when in service (for example, minimum wall thickness over a certain percentage of the tubular and no more than a certain number of pits, cracks or other anomalies above a certain size or depth). A summary report may then be produced that may summarize and highlight key points of interest in the comparison, including anomalies in OD measurements. In addition, the Scorpion System may generate "One-Way Tracking Tags" that may be affixed to each length of tubular processed by the System. Each tag advantageously includes serial number information (which may be in the form of bar codes) that ties the tubular to any corresponding cleaning and inspection information collected or generated by the Scorpion System.

It will be appreciated that with regard to comparison to the expected signature of a tubular that meets all applicable performance specifications, the DAS provides an advantageous substitute to conventional EMI analysis. Information regarding the condition of the tubular may be obtained concurrently with cleaning operations, potentially obviating the need for additional, separate EMI analysis after cleaning.

The current signature of the tubular may also be compared with earlier corresponding signatures of the same tubular to identify specific changes in the tubular since the previous inspection. Alternatively, the current signature of the tubular may be compared against stored data sets or other known signatures where such a comparison will be expected to identify areas of interest in the tubular such as deterioration of wall integrity, or other wear or damage. Such stored data sets or known signatures might include, for example, "perfect pipe" in one type of comparison, or tubulars with known defects or wear and tear in another type of comparison.

In the currently preferred embodiment, the signature of the tubular appears as a series of graphs and other visual media. This makes comparison with paradigms or previous signature of the tubular relatively straightforward. Nothing in this disclosure should be interpreted, however, to limit the DAS or the Scorpion System in this regard.

One advantage of the DAS is that it is operable on a rotating tubular specimen. It will be appreciated that sensors scanning or sampling a rotating tubular are able to discern characteristics of the tubular that would either be undetectable or poorly detectable on a stationary tubular. For example, without limitation, the following characteristics are detectable (or better detectable) when the tubular is rotating:

(a) Vibrational frequency and amplitude;

(b) Harmonic response characteristics;

(c) Torsional displacement in response to torsional load; or (d) Responses to sonic, optical or magnetic radiation It will be further appreciated that by rotating the tubular during sensing or sampling, logs over the tubular become available that enable high resolution in pinpointing an item of interest, such as a defect or an anomaly, or a tubular identification or tracking tag. The sensing and sampling then goes well beyond accurate pinpointing, enabling real time qualitative analysis of the item of interest. As noted above, the DAS may obviate current manual electromagnetic and sonic analysis of lengths of tubulars, one-by-one.

Sensors on the DAS are connected to the processing unit by conventional telemetry, such as hard wire cables, wireless telemetry or optical cables. The telemetry selected will depend on environmental conditions such as distance over which telemetry is required, bandwidth and signal interference levels.

As disclosed earlier, the DAS may be embodied on any conventional data acquisition system whose performance matches the needs of the Scorpion System for obtaining, processing, comparing and displaying sensor readings and samples in real time. In a currently preferred embodiment of the DAS, however, the applicable software is advantageously customized to the Scorpion System via conventional programming to achieve the following operational goals and advantages:

(1) Receive and process a high sampling rate from many sensors, so as to effectively sample the tubular in real time with high resolution. Such high resolution comes not only from a high sample rate at each sensor, but also from concurrently processing samples from a high number of sensors.

(2) Display the output in easily-readable graphical formats, with the capability to "drill down" or "magnify" on areas of specific interest. The resolution level is able to support such magnification.

(3) Display the output against user selected paradigm(s) so that differences can be easily identified and characterized. The paradigms have the same resolution as the real time data so that magnification of areas of interest supports a true, full comparison with the paradigm.

(4) Display the output remotely, allowing review of data and comparisons away from the machine. Such remote review may be enabled by transmission of local data to remote terminals, or by linking remote terminals to local terminals via conventional terminal-sharing applications such as GoToMeeting by Citrix.

A paradigm for optimal Scorpion System operating efficiency includes being able to program the ODS to run automatically. That is, to repeat a cycle of tubular exterior processing operations (including cleaning and data acquisition operations) as a series of tubulars are automatically and synchronously: (1) placed into position at the beginning of the cycle, (2) ejected at the end of the cycle, and then (3) replaced to start the next cycle. It may also be advantageous in some embodiments (although the Scorpion System is not limited in this regard) to synchronize ODS and MLI operations. Specifically, embodiments of the electronic control system of the Scorpion System allow users to select a "Dirtiness Factor" for a tubular (or series thereof). The Dirtiness Factor reflects a weighted estimate including an assessment of the severity of the tubular's contamination and the level of clean required by the Scorpion System. All speeds, pressures, distances and other relevant factors for cleaning operations are then automatically generated according to the Dirtiness Factor and fed into the cleaning systems of the Scorpion System. The goal by applying and following the Dirtiness Factor regimen is to clean the tubular 100% to the level selected before cleaning in one pass, without having to return and re-clean. As a result, the Scorpion System's cleaning efficiency with respect to time and quality will be maximized, while still giving the desired level of clean. Similarly, the consumption of consumables such as brushes, liquids, fluids, etc., used in the cleaning process will be minimized, while still giving the desired level of clean.

In automatic mode on the ODS, the user may specify the sequence of ODS operations in a cycle on each tubular. The cycle of ODS operations will then be enabled and controlled automatically, including causing the ODS buggy to travel up and down above a tubular, with corresponding repositioning of ODS buggy (if required) with respect to the tubular. If applicable, the cycle may also include coordinating ODS operations in a cycle with concurrent MLI operations. The cycle may be repeated in automatic mode, as tubulars are sequentially placed into position. In semi-automatic mode, the operation may be less than fully automatic in some way. For example, a cycle may be user-specified to only run once, so that tubulars may be manually replaced between cycles. In manual mode, the user may dictate each ODS operation individually, and the ODS may then pause and wait for further user instruction.

For the avoidance of doubt, a "cycle" as described immediately above may comprise one pass or multiple passes of (1) the ODS, and/or of (2) user-selected lances in the MLI through each tubular, all in order to enable a user-selected sequence of operations. Nothing in this disclosure should be interpreted to limit the Scorpion System in this regard. Further, again for the avoidance of doubt, in a currently preferred embodiment of the Scorpion System, the ODS may run synchronously or asynchronously with some or all of the lances on the MLI, all according to user selection.

The Scorpion System as described in this disclosure is designed to achieve the following operational goals and advantages:

Versatility.

The Scorpion System as disclosed herein has been described with respect to currently preferred embodiments. However, as has been noted repeatedly in this disclosure, such currently preferred embodiments are exemplary only, and many of the features, aspects and capabilities of the Scorpion System are customizable to user requirements. As a result the Scorpion System is operable on many diameters of tubular in numerous alternative configurations. Some embodiments may be deployed onto a U.S. Department of Transport standard semi-trailer for mobile service.

Substantially Lower Footprint of Cleaning Apparatus.

As noted above, conventionally, the cleaning of range 3 drill pipe requires a building at least 120 feet long. Certain configurations of the Scorpion System can, for example, clean range 3 pipe in a building of about half that length. Similar footprint savings are available for rig site deployments. As also noted above, a mobile embodiment of the Scorpion System is designed within U.S. Department of Transportation regulations to be mounted on an 18-wheel tractor-trailer unit and be transported on public roads in everyday fashion, without requirements for any special permits.

Dramatically Increased Production Rate in Cleaning.

An operational goal of the Scorpion System is to substantially reduce conventional cleaning time. Further, the integrated yet independently-controllable design of each phase of cleaning operations allows a very small operator staff (one person, if need be) to clean numerous tubulars consecutively in one session, with no other operator involvement needed unless parameters such as tubular size or cleaning requirements change. It will be further understood that in order to optimize productivity, consistency, safety and quality throughout all tubular operations, the systems enabling each phase or aspect of such operations are designed to run independently, and each in independently-selectable modes of automatic, semi-automatic or manual operation. When operator intervention is required, all adjustments to change, for example, modes of operation or tubular size being cleaned, such adjustments are advantageously enabled by hydraulically-powered actuators controlled by system software.

Improved Quality of Clean.

It is anticipated that the Scorpion System will open up the pores of the metal tubular much better than in conventional cleaning, allowing for a more thorough clean. In addition, the high rotational speed of the tubular during cleaning operations allows for a thorough clean without a spiral effect even though cleaning may optionally be done in one pass.

Throughout this disclosure, reference has been made to software-driven electronic control systems and data acquisition/processing systems. It will be understood that such systems may be embodied on software executable on conventional computers, networks, peripherals and other data processing hardware.

Also, throughout this disclosure, conventional control, power and hydraulic/pneumatic actuating systems for features and aspects of the disclosed technology have been omitted for clarity. Likewise, conventional support structure for features and aspects of the disclosed technology, such as structural steel, has been omitted for clarity.

Although the present invention and its advantages have been described in detail, it should be understood that various changes, substitutions and alternations can be made herein without departing from the spirit and scope of the invention as defined by the appended claims.

I claim:

1. A swivel abrader assembly, comprising:

a vertically-adjustable mounting mechanism;

a swivel mechanism attached to the mounting mechanism such that, responsive to first user instructions, the mounting mechanism adjusts the swivel mechanism to a predetermined swivel mechanism elevation above a preselected horizontal datum plane;

an abrader assembly, the abrader assembly including an independently-rotatable abrader, the abrader assembly suspended from the swivel mechanism by a tilting mechanism, the tilting mechanism disposed to tilt about a pivot axis parallel to the datum plane;

the abrader assembly, responsive to operational contact on the abrader, disposed to tilt about the pivot axis via the tilting mechanism while the abrader is rotated at a user-selectable speed; and the abrader assembly also rotatably connected to the swivel mechanism such that, responsive to second user instructions, the swivel mechanism rotates the abrader about a vertical swivel axis perpendicular to the datum plane and sets the abrader at a predetermined abrader orientation relative to a preselected datum azimuth.

2. The swivel abrader assembly of claim 1, in which the abrader assembly is disposed, responsive to operational contact on the abrader, to tilt about the pivot axis against spring bias in the tilting mechanism.

3. The swivel abrader assembly of claim 1, in which the abrader has a centroid that coincides with the swivel axis.

4. The swivel abrader assembly of claim 1, in which the abrader has a centroid that is displaced from the swivel axis.

5. The swivel abrader assembly of claim 1, in which the abrader has an oblate spheroid shape.

6. The swivel abrader assembly of claim 5, in which the oblate spheroid shape has a longitudinal axis, first and second ends, and a midpoint between the first and second ends, and in which the abrader further comprises a laminate of a plurality of planar circular abraders whose centers coincide with the longitudinal axis, the laminate including a smallest diameter abrader at the first and second ends increasing up to a largest diameter abrader at the midpoint.

7. The swivel abrader assembly of claim 1, in which the tilting mechanism further comprises a tilt bar from which the abrader assembly is suspended, the tilt bar disposed to see-saw about a fulcrum coinciding with the pivot axis.

8. The swivel abrader assembly of claim 7, in which see-saw movement of the tilt bar about the fulcrum is spring biased.

9. The swivel abrader assembly of claim 8, in which resistance against see-saw movement of the tilt bar about the fulcrum is provided by opposing compression springs at either end of the tilt bar.

10. The swivel abrader assembly of claim 1, in which the first user instructions are supplied by elevation monitoring, above the datum plane, of a portion of a workpiece scheduled to make future operational contact with the abrader.

11. A swivel abrader assembly, comprising:

a swivel mechanism, the swivel mechanism disposed to be adjusted to a predetermined swivel mechanism elevation above a preselected horizontal datum plane;

an abrader assembly, the abrader assembly including an independently-rotatable abrader, the abrader assembly suspended from the swivel mechanism by a tilting mechanism, the tilting mechanism disposed to tilt about a pivot axis parallel to the datum plane;

the abrader assembly, responsive to operational contact on the abrader, disposed to tilt about the pivot axis via the tilting mechanism while the abrader is rotated at a user-selectable speed; and the abrader assembly also rotatably connected to the swivel mechanism such that, responsive to user instructions, the swivel mechanism rotates the abrader about a vertical swivel axis perpendicular to the datum plane and sets the abrader at a predetermined abrader orientation relative to a preselected datum azimuth.

12. The swivel abrader assembly of claim 11, in which the abrader has an oblate spheroid shape.

13. The swivel abrader assembly of claim 12, in which the oblate spheroid shape has a longitudinal axis, first and second ends, and a midpoint between the first and second ends, and in which the abrader further comprises a laminate of a plurality of planar circular abraders whose centers coincide with the longitudinal axis, the laminate including a smallest diameter abrader at the first and second ends increasing up to a largest diameter abrader at the midpoint.

14. The swivel abrader assembly of claim 11, in which the tilting mechanism further comprises a tilt bar from which the abrader assembly is suspended, the tilt bar disposed to see-saw about a fulcrum coinciding with the pivot axis.

15. The swivel abrader assembly of claim 14, in which see-saw movement of the tilt bar about the fulcrum is spring biased.

16. A swivel abrader assembly, comprising:

a swivel mechanism, the swivel mechanism disposed to be adjusted to a predetermined swivel mechanism elevation above a preselected horizontal datum plane;

an abrader assembly including an independently-rotatable abrader, the abrader assembly suspended from the swivel mechanism by a tilting mechanism, the tilting mechanism disposed to tilt about a pivot axis parallel to the datum plane;

the abrader assembly, responsive to operational contact on the abrader, disposed to tilt about the pivot axis against spring bias in the tilting mechanism while the abrader is rotated at a user-selectable speed;

the abrader assembly also rotatably connected to the swivel mechanism such that, responsive to user instructions, the swivel mechanism rotates the abrader about a vertical swivel axis perpendicular to the datum plane and sets the abrader at a predetermined abrader orientation relative to a preselected datum azimuth; and the abrader having an oblate spheroid shape and a centroid that coincides with the swivel axis.

17. The swivel abrader assembly of claim 16, in which the oblate spheroid shape has a longitudinal axis, first and second ends, and a midpoint between the first and second ends, and in which the abrader further comprises a laminate of a plurality of planar circular abraders whose centers coincide with the longitudinal axis, the laminate including a smallest diameter abrader at the first and second ends increasing up to a largest diameter abrader at the midpoint.

18. The swivel abrader assembly of claim 16, in which the tilting mechanism further comprises a tilt bar from which the abrader assembly is suspended, the tilt bar disposed to see-saw about a fulcrum coinciding with the pivot axis.

19. The swivel abrader assembly of claim 18, in which see-saw movement of the tilt bar about the fulcrum is spring biased.

20. The swivel abrader assembly of claim 19, in which resistance against see-saw movement of the tilt bar about the fulcrum is provided by opposing compression springs at either end of the tilt bar.

* * * * *